US007686475B2

(12) United States Patent
Koike et al.

(10) Patent No.: US 7,686,475 B2
(45) Date of Patent: Mar. 30, 2010

(54) LIGHTING FIXTURE

(75) Inventors: Teruo Koike, Tokyo (JP); Shoichi Banba, Tokyo (JP); Katsura Tsukada, Tokyo (JP); Mitsuo Yamada, Tokyo (JP); Satoshi Nagasawa, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 12/195,171

(22) Filed: Aug. 20, 2008

(65) Prior Publication Data

US 2009/0027883 A1 Jan. 29, 2009

Related U.S. Application Data

(63) Continuation of application No. PCT/JP2007/052859, filed on Feb. 16, 2007.

(30) Foreign Application Priority Data

Feb. 20, 2006 (JP) ..... 2006-041867
Feb. 27, 2006 (JP) ..... 2006-050614

(51) Int. Cl.
*F21V 7/09* (2006.01)

(52) U.S. Cl. ..... 362/249.01; 362/249.02; 362/294; 362/373; 362/800; 362/227

(58) Field of Classification Search ..... 362/294, 362/373, 800
See application file for complete search history.

(56) References Cited

U.S. PATENT DOCUMENTS 6,250,774 B1 * 6/2001 Begemann et al. ..... 362/231
7,281,820 B2 * 10/2007 Bayat et al. ..... 362/245
7,357,546 B2 4/2008 Ishida
7,506,995 B2 * 3/2009 Thomas et al. ..... 362/227
7,513,639 B2 * 4/2009 Wang ..... 362/218

(Continued)

FOREIGN PATENT DOCUMENTS

JP 10269820 10/1998

(Continued)

OTHER PUBLICATIONS

International Search Report for PCT Patent App. No. PCT/JP2007/052859 (May 15, 2007).

*Primary Examiner*—Anabel M Ton
(74) *Attorney, Agent, or Firm*—Cermak Kenealy Vaidya & Nakajima LLP

(57) ABSTRACT

Light emitting device modules illuminate at a wide angle in the longitudinal direction of a lighting fixture. The lighting fixture can be provided with a light emitting device module having a light emitting device, an installation member for mounting multiple light emitting device modules thereon, and a support for supporting the installation member. The installation member 2 can be bent in multiple stages so that light beams from the multiple light emitting device modules mounted on the installation member are pointed to multiple different directions. The installation member can be bent in multiple stages so that an angle between the main optical axis line of the light emitting device module mounted on the forefront part of the installation member and a horizontal plane is smaller than the angle between the main optical axis line of the light emitting device module mounted on the root part of the installation member and the horizontal plane.

19 Claims, 12 Drawing Sheets

U.S. PATENT DOCUMENTS

| | | | | |
|---|---|---|---|---|
| 7,588,355 | B1 * | 9/2009 | Liu et al. | 362/373 |
| 2007/0285920 | A1 * | 12/2007 | Seabrook | 362/240 |
| 2009/0027887 | A1 * | 1/2009 | Yamada et al. | 362/252 |
| 2009/0262543 | A1 * | 10/2009 | Ho | 362/373 |

FOREIGN PATENT DOCUMENTS

| | | |
|---|---|---|
| JP | 2000507042 | 6/2000 |
| JP | 2002033011 | 1/2002 |
| JP | 2004158292 | 6/2004 |
| JP | 2004200102 | 7/2004 |

* cited by examiner (A)

(B)

(B)

(A)

(B)

(A)

(B)

FIG.9
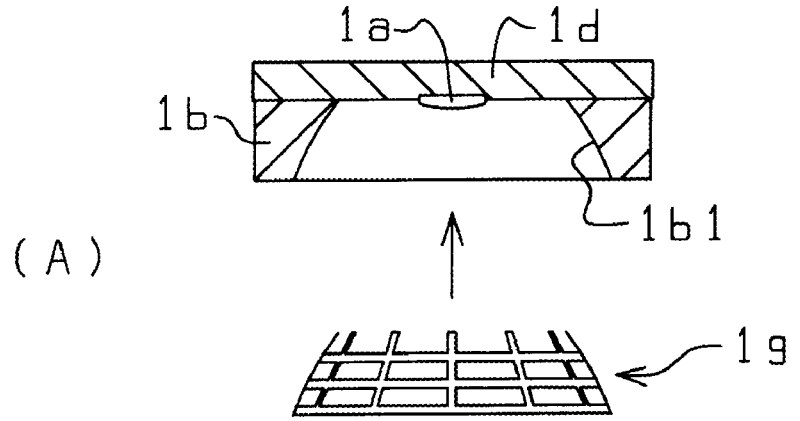
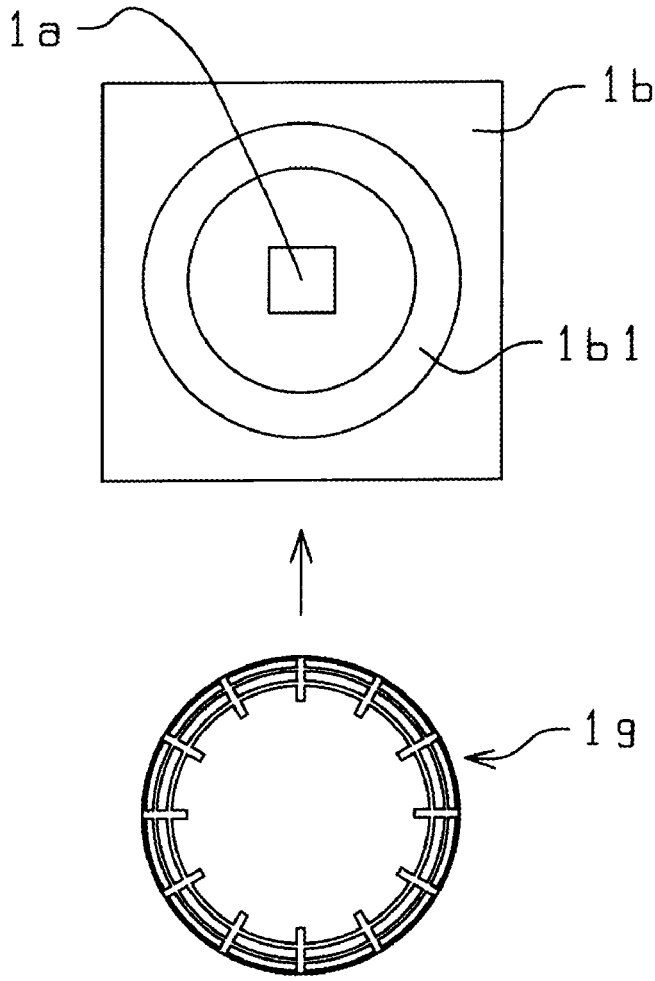
FIG. 9

(A)

(B)

LIGHTING FIXTURE

This application is a continuation under 35 U.S.C. §120 of PCT Patent Application No. PCT/JP2007/52859, filed on Feb. 16, 2007, which also claims the priority benefit of Japanese Patent Application Nos. 2006-041867 (filed on Feb. 20, 2006) and 2006-050614 (filed on Feb. 27, 2006), which are hereby incorporated in their entireties by reference.

BACKGROUND

1. Technical Field

The disclosed subject matter relates to a lighting fixture having an installation member which is bent in multiple stages, and in such a manner that light beams from multiple light emitting device modules mounted on the installation member are pointed in multiple different directions, respectively.

2. Description of the Related Art

The lighting fixture described in Japanese Published Unexamined Patent Application No. 2004-200102, for example, is equipped with a light emitting device module having a light emitting device, an installation member for mounting multiple light emitting devices, and a support member for supporting the installation member. Here, the installation member is bent in multiple stages so that light from the multiple light emitting device modules that are mounted on the installation member are pointed in multiple different directions.

Furthermore, in this lighting fixture, one light emitting device module is made up of multiple white light-emitting diodes and one planar printed-circuit board. In addition, five light-emitting modules are mounted respectively on the five stages on the bent installation member. Furthermore, the installation member on which five light emitting device modules are mounted is supported by the support member. The installation member is bent in five stages in a left-right (lateral) direction.

Therefore, as to the installation member which is bent in five stages in the lateral direction, an angle, between a main optical axis line of the light emitting device module mounted on a central part of the installation member and a horizontal plane, is the largest; an angle, between a main optical axis line of the light emitting device module mounted on a part of the right side of the central part and the horizontal plane, is the second largest; and an angle, between a main optical axis line of the light emitting device module mounted on a part of the even further right side and the horizontal plane, is the smallest.

As to the installation member which is bent in five stages in the lateral direction, an angle, between a main optical axis line of the light emitting device module mounted on the central part of the installation member and the horizontal plane, is the largest; an angle, between a main optical axis line of the light emitting device module mounted on a part of the left side of the central part and the horizontal plane, is the second largest; and an angle, between a main optical axis line of the light emitting device module mounted on a part of the even further left side and the horizontal plane, is the smallest.

Consequently, the light beams from the five light emitting device modules mounted on the installation member are directed in five directions, and the left-right sides of the lighting fixture is illuminated at a wide angle. Therefore, in the case where the lighting fixture is installed on the edge of a road, the light emitting device modules are allowed to illuminate at a wide angle in the traveling direction of the road.

In addition, the lighting fixture described in the Japanese Published Unexamined Patent Application No. 2004-200102 has an installation member which is bent in the lateral direction, but it is not bendable in the longitudinal direction.

Since the installation member is bent in the lateral direction in this lighting fixture, the angle between the main optical axis line of the light emitting device module mounted on the right or left side of the installation member, and the horizontal plane, is smaller than the angle between the main optical axis line of the light emitting device module mounted on the central part of the installation member, and the horizontal plane. However, in the light emitting device module mounted on the central part of the installation member, the main optical axis line of the white light-emitting diode located on the forefront is approximately parallel with the main optical axis line of the white light-emitting diode located on the root side, because the installation member is not bent in the longitudinal direction.

As a result, this lighting fixture allows illumination from the light emitting device modules at a wide angle in the lateral direction of the lighting fixture, but it is not capable of illuminating at a wide angle in the longitudinal direction of the lighting fixture. Therefore, if a position close to the lighting fixture in the front side thereof is attempted to be illuminated brightly, a position distant from the lighting fixture may not be illuminated brightly. On the other hand, if the position distant from the lighting fixture in the front side thereof is attempted to be illuminated brightly, the position close to the lighting fixture may not be illuminated brightly.

More particularly, when the lighting fixture is installed on the edge of the road, it is not difficult to illuminate at a wide angle in the direction of road lane. Consequently, in the direction of a road lane, only either one of the following can be illuminated brightly, a road surface at a position close to the lighting fixture, or a road surface at a position distant from the lighting fixture.

SUMMARY

In view of the problems, characteristic and features of the related art described above, one aspect of the disclosed subject matter is to provide a lighting fixture which allows illumination from the light emitting device modules at wide angle in the longitudinal direction of the lighting fixture. In other words, a lighting fixture is disclosed which is capable of brightly illuminating both a position close to the fixture and a position distant therefrom, in front of the lighting fixture.

More particularly, a lighting fixture can be configured in accordance with principles of the disclosed subject matter to be capable of brightly illuminating both a position of the road surface close to the fixture and a position of the road surface distant therefrom, in the road lane direction.

According to the disclosed subject matter, a lighting fixture can be provided which incorporates a light emitting device module having a light emitting device, an installation member for mounting multiple light emitting device modules, and a support member for supporting the installation member, the installation member being bent in multiple stages in such a manner that light beams from the multiple light emitting device modules mounted on the installation member are directed in more than one different direction. Thus, an angle, between a main optical axis line of the light emitting device module mounted on a forefront side of the installation member and a horizontal plane, becomes smaller than an angle, between the main optical axis line of the light emitting device module mounted on a root side of the installation member and the horizontal plane.

According to another aspect of the disclosed subject matter, a lighting fixture can be configured to allow the installation member to be bent in multiple stages in the longitudinal direction of the lighting fixture. Therefore, an angle, between the main optical axis line of the light emitting device module mounted on the forefront side of the installation member and the horizontal plane, is smaller than an angle, between the main optical axis line of the light emitting device module mounted on the root side of the installation member and the horizontal plane.

A main optical axis line of the light emitting device module mounted on the forefront side of the installation member can be directed to a position distant from the lighting fixture in the front side thereof, and a main optical axis line of the light emitting device module mounted on the root side of the installation member can be directed to a position close to the lighting fixture in the front side thereof.

Therefore, the lighting fixture of the disclosed subject matter can be configured to allow illumination from the light emitting device modules at a wide angle in the longitudinal direction of the lighting fixture. In other words, it is possible to brightly illuminate both a position close to the lighting fixture and a position distant therefrom in front of the lighting fixture. If such an example of a lighting fixture made in accordance with principles of the disclosed subject matter is installed on the edge of a road, both a road surface at the position close to the lighting fixture and a road surface at the position distant therefrom in the road lane direction can be brightly illuminated.

In addition, in the exemplary lighting fixture described above, the main optical axis line of the light emitting device module mounted on the forefront side of the installation member is directed to a position distant from the lighting fixture. Therefore, an optical path from the light emitting device module can be made shorter than the case where the main optical axis line of the light emitting device module mounted on the root side of the installation member is directed to the position distant from the lighting fixture in the front side thereof. Accordingly, the position distant therefrom can be brightly illuminated.

A lens may be provided to focus the light beams emitted from the light emitting devices. In addition, a converging property of the lens can be adjusted so that a converging degree in the lateral direction of the lighting fixture is made smaller than the converging degree in the longitudinal direction of the lighting fixture.

Therefore, it is possible for the light emitting device modules to illuminate at a wide angle in the lateral direction of the lighting fixture, while keeping the size small in the lateral direction of the light emitting device module.

Consequently, the lighting fixture allows the light emitting device modules to illuminate at a wide angle in the lateral direction of the lighting fixture, while keeping the size small in the lateral direction with respect to the installation member on which multiple light emitting device modules are mounted.

In other words, the lighting fixture can be configured to allow illumination from the light emitting device modules at a wide angle in the lateral direction of the lighting fixture, while keeping the multiple light emitting device modules and the installation member small and protruding less from the support member in the lateral direction.

When the installation member is divided into multiple partitions and the light emitting device modules of the same number as that of the partitions of the installation member are mounted on the installation member, a light beam from a light emitting device module mounted on one partition overlaps a light beam from another light emitting device module mounted on a different partition.

In view of this point, the installation member can be divided into multiple partitions, and light emitting device modules, whose number is less than the number of partitions of the installation member, are mounted on the installation member, so as to reduce the possibility that the light beam from one light emitting device module mounted on a partition overlaps the light beam from another light emitting device module mounted on a different partition.

Therefore, it is possible to reduce the number of light emitting device modules, without deterioration of global performance of the light fixture. As a result, it is possible to reduce production cost and operation cost associated with the lighting fixture, without a resultant deterioration in global performance of the light fixture.

In other words, partitions can be formed on the installation member in a number larger than the number of light-emitting modules. Therefore, a partition where the light emitting device module is mounted can be changed, that is, a position at which the light emitting device module is mounted can be changed, whereby the global property of the lighting fixture can be easily modified. In other words, it is possible to easily modify the global property of the lighting fixture, depending on the condition of how the lighting fixture is installed.

An LED can be used as the light emitting device. In addition, a fluorescent substance can be arranged in a manner such that it covers the LED. A reflector can also be provided having a reflection surface that reflects light from the LED and the fluorescent substance. The reflection surface can be further provided with a part where a light-storage material is placed and a part where the light-storage material is not placed.

In other words, in the lighting fixture, the light-storage material can be arranged on the reflection surface that reflects the light from the LED and the fluorescent substance. Therefore, the light is stored in the light-storage material while the LED is turned ON, and it can be used for illumination when the LED is turned OFF. Accordingly, auxiliary light can be used for illumination while the LED is OFF, thereby reducing power consumption of the LED.

In the lighting fixture, the fluorescent substance can be selected with the primary intended purpose of color reproducibility and high brightness. This enables achievement of three purposes simultaneously, energy saving, color reproducibility, and high brightness.

The light-storage material can be applied to the reflection surface in the form of mesh or in the form of dots.

In addition, a mesh-like sheet containing the light-storage material can be attached to the reflection surface.

Alternatively, in the lighting fixture, the reflector to which the light-storage material is applied can be covered by a sheet having holes.

In the lighting fixture the reflector can be made of a material to which the light-storage material is added. For example, the reflector can be molded using the material to which the light-storage material is added.

In other words, in the lighting fixture, the light-storage material is not placed all over the reflection surface, but there remains a part where the light-storage material is not placed. Therefore, a reflection ratio of the reflection surface can be improved as compared to the case where the light-storage material is placed over the entire surface, thereby reducing the possibility that the reflected light from the reflection surface is weakened when the LED is turned ON. In other words, the lighting fixture can enable illumination by the auxiliary light when the LED is OFF, therefore reducing the possibility that the reflected light from the reflection surface is weakened when the LED is turned ON.

The lighting fixture can include a heat transfer member placed between the LED and fluorescent substance, and the light-storage material. In other words, the LED and fluorescent substance, and the light-storage material are thermally connected. A heat sink can be placed between the LED and the fluorescent substance, and the light-storage material. Therefore, the temperature of the light-storage material is raised by the heat generated by the LED, thereby enhancing emission intensity of the light-storage material.

BRIEF DESCRIPTION OF DRAWINGS

These and other characteristics, features, and advantages of the presently disclosed subject matter will become clear from the following description with reference to the accompanying drawings, wherein:

FIGS. 9(A) & (B) are an enlarged assembly side view and an enlarged assembly top view, respectively, of another example of a light emitting device (LED package), reflector, and thermal interface material made in accordance with principles of the disclosed subject matter;

DETAILED DESCRIPTION OF EXEMPLARY EMBODIMENTS

A description will now be made below with respect to examples of the presently disclosed subject matter with reference to the accompanying drawings and in accordance with exemplary embodiments.

Figure 1:
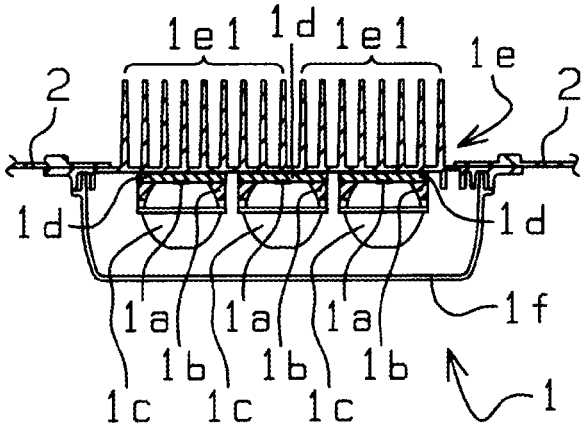
FIGS. 1(A)-(D) are a partial cross-sectioned side view, front view, lower perspective view, and bottom view, respectively, illustrating an example of a light emitting device module constituting a part of a lighting fixture made in accordance with principles of the disclosed subject matter.
Figure 1:
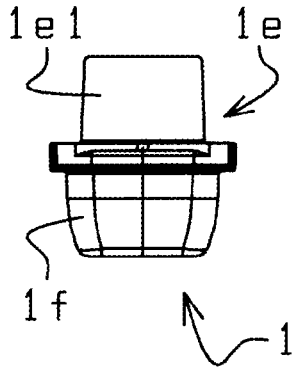
Figure 1:
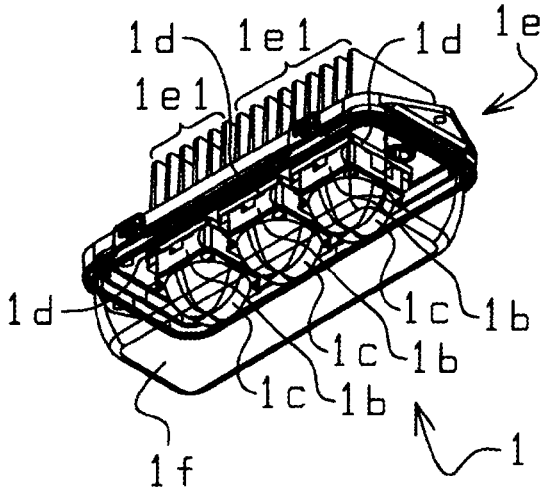
Figure 1:
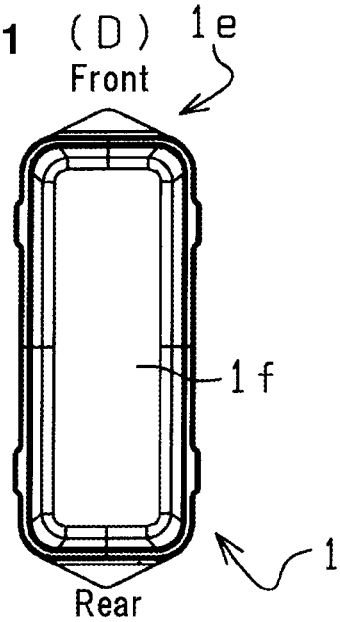

FIG. 1 illustrates a light emitting device module 1 which constitutes a part of a first embodiment of a lighting fixture made in accordance with principles of the disclosed subject matter. In more detail, FIG. 1(A) is a left side view of the light emitting device module 1, which is partially illustrated as a sectional view, FIG. 1(B) is a front view of the light emitting device module 1, FIG. 1(C) is a perspective view from the front, left and lower side, and FIG. 1(D) is a bottom view of the light emitting device module 1.

In FIG. 1, the reference numeral 1*a* indicates a light emitting device such as an LED, for instance. The reference numeral 1*b* indicates a reflector being provided with a reflection surface for reflecting the light emitted from the light emitting device 1*a* downwardly (toward the lower side in FIG. 1(A) and FIG. 1(B)). The reference numeral 1*c* indicates a lens mounted on the reflector 1*b* for controlling a light distribution of the light emitted directly from the light emitting device 1*a* and the light reflected from the reflection surface of the reflector 1*b*.

In FIG. 1, the reference numeral 1*d* indicates a thermal interface material for supporting the light emitting device 1*a* and the reflector 1*b*, and for radiating or conducting heat generated by the light emitting device 1*a*. The reference numeral 1*e* indicates housing for supporting the thermal interface material 1*d*. The reference numeral 1*e*1 indicates a fin which constitutes a part of the housing 1*e*. The reference numeral 1*f* indicates a cover for covering the light emitting device 1*a*, the reflector 1*b*, the lens 1*c*, and the thermal interface material 1*d*. The reference numeral 2 indicates an installation member for mounting the light emitting device 1 thereon.

In the lighting fixture according to the first embodiment, a part of the heat generated by the light emitting device 1*a* is radiated from the thermal interface material 1*d*. In addition, a part of the heat generated from the light emitting device 1*a* is thermally conducted to the fin 1*e*1 of the housing 1*e*, via the thermal interface material 1*d*, and the heat is then radiated from the fin 1*e*1. Furthermore, a part of the heat generated from the light emitting device 1*a* is thermally conducted to the installation member 2, via the thermal interface material 1*d* and the housing 1*e*, and the heat is then radiated from the installation member 2.

In addition, in the lighting fixture according to the first embodiment, as shown in FIG. 1, three sets of the light emitting device 1*a*, the reflector 1*b*, and the lens 1*c* are provided on one light emitting device module 1. As a second embodiment, any number of sets of the light emitting device 1*a*, the reflector 1*b*, and the lens 1*c*, other than three sets may be incorporated into one light emitting device module 1.

Figure 2:
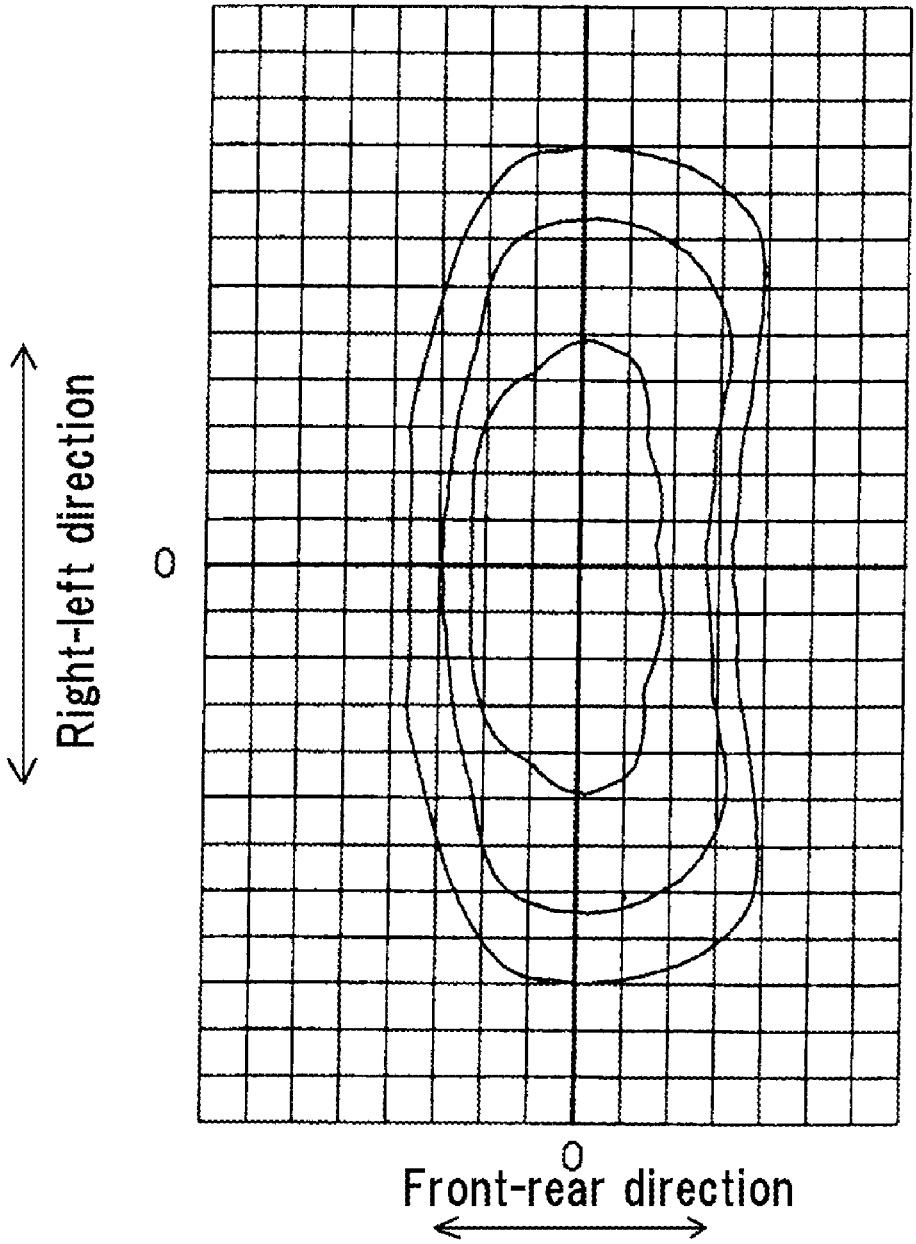
FIG. 2 illustrates a light distribution pattern of the light emitted from the light emitting device module of FIGS. 1(A)-(D)

FIG. 2 illustrates a light distribution pattern, which is emitted from the light emitting device module 1 shown in FIG. 1. The left side of FIG. 2 corresponds to the rear side (lower-left side of FIG. 1(C)) of the light emitting device module 1 as shown in FIG. 1, and the right side of FIG. 2 corresponds to the front side (upper-right side of FIG. 1(C)) of the light emitting device module 1 shown in FIG. 1. The upper side of FIG. 2 corresponds to the right side (lower-right side of FIG. 1(C)) of the light emitting device module 1 shown in FIG. 1, and the lower side of FIG. 2 corresponds to the left side (upper-left side of FIG. 1(C)) of the light emitting device module shown in FIG. 1.

In the lighting fixture of the first embodiment, as shown in FIG. 1 and FIG. 2, a converging property of the lens 1*c* is configured in such a manner that a degree of light convergence of the light emitting device module 1 in the lateral direction (in the front-rear direction of FIG. 1(A), lateral direction of FIG. 1(B), upper left-lower right direction of FIG. 1(C), lateral direction of FIG. 1(D), and upper-lower direction of FIG. 2) is made to be smaller than the degree of light convergence of the light emitting device module 1 in the longitudinal direction (in the lateral direction of FIG. 1(A), the front-rear direction of FIG. 1(B), upper right-lower left direction of FIG. 1(C), upper-lower direction of FIG. 1(D), and lateral direction of FIG. 2).

In other words, in the light fixture of the first embodiment, as shown in FIG. 2, the light distribution pattern emitted from the light emitting device module 1 is set as being longer in the lateral direction (upper-lower direction in FIG. 2) than in the longitudinal direction (lateral direction in FIG. 2).

Figure 3:
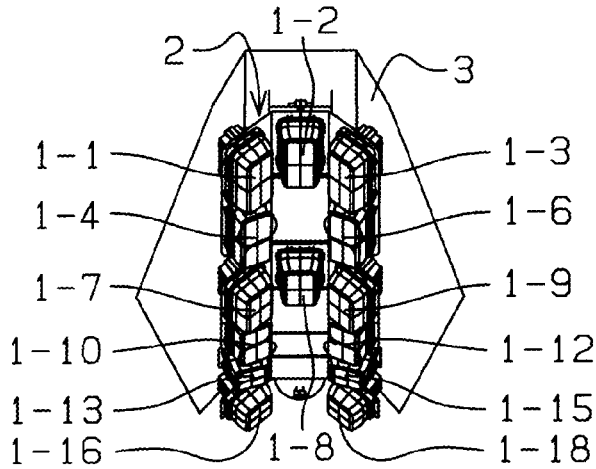
FIGS. 3(A) & (B) are an upper perspective view and a lower perspective view, respectively, illustrating an installation member on which multiple light emitting device modules of FIG. 1 are mounted, and a lampshade for covering the multiple light emitting device modules and the installation member.
Figure 3:
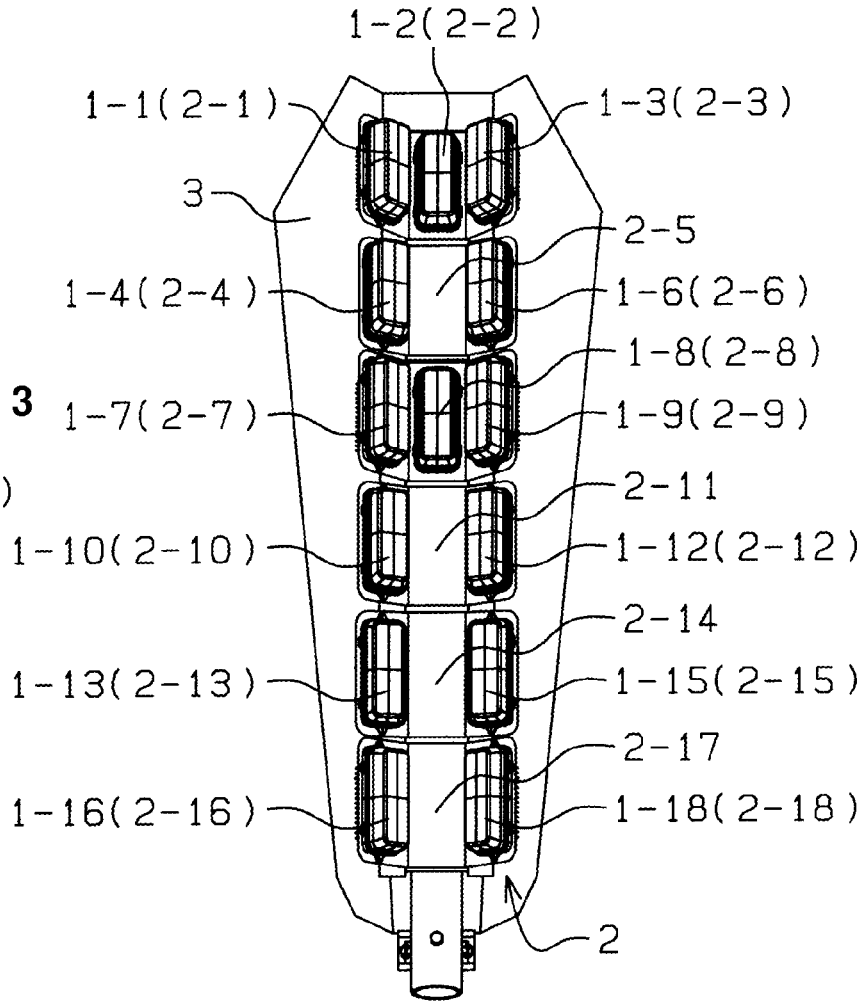
Figure 4:
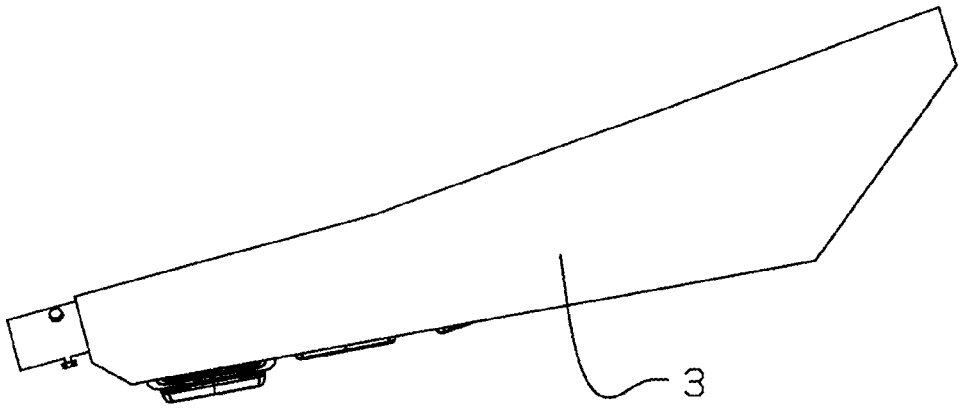
FIGS. 4(A) & (B) are a side view and a partial side view, respectively, illustrating an installation member on which multiple light emitting device modules of FIG. 1 are mounted, and a lampshade for covering the multiple light emitting device modules and the installation member.
Figure 4:
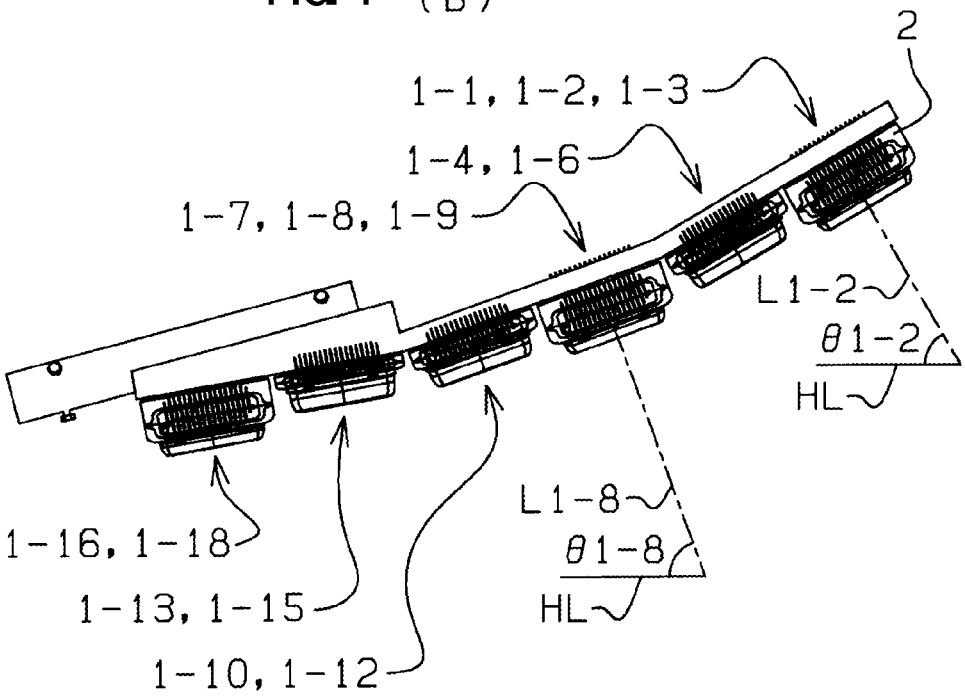

Hereinafter, with reference to FIG. 3 and FIG. 4, a structure of the lighting fixture according to the first embodiment will be described in detail. FIG. 3 and FIG. 4 illustrate the installation member 2, on which multiple light emitting device modules 1, each as shown in FIG. 1 are mounted, and a lampshade 3 for covering the multiple light emitting device modules 1 and the installation member 2. More particularly, FIG. 3(A) is a front view of the installation member 2 and the lampshade 3, FIG. 3(B) is a bottom view of the installation member 2 and the lampshade 3, FIG. 4(A) is a left side view of the lampshade 3, and FIG. 4(B) is a left side view of the installation member 2, seen through a part of the lampshade 3.

In the lighting fixture according to the first embodiment, as shown in FIG. 3(A) and FIG. 3(B), the installation member 2 is divided into eighteen partitions, 2-1, 2-2, 2-3, 2-4, 2-5, 2-6, 2-7, 2-8, 2-9, 2-10, 2-11, 2-12, 2-13, 2-14, 2-15, 2-16, 2-17, and 2-18. Then, fourteen units of the light emitting device modules 1 each as shown in FIG. 1 (1-1, 1-2, 1-3, 1-4, 1-6, 1-7, 1-8, 1-9, 1-10, 1-12, 1-13, 1-15, 1-16, 1-18) are mounted respectively on the fourteen partitions, among the eighteen partitions described above.

In more detail, the partition 2-1 and the partition 2-2, and the partition 2-3 are bent at two stages, and formed in a concave shape (more particularly, a concave shape when viewed from the lower side). As a result, the light emitting device module 1-1 mounted on the partition 2-1, the light emitting device module 1-2 mounted on the partition 2-2, and the light emitting device 1-3 mounted on the partition 2-3 are pointed in different directions.

Similarly, the partition 2-4, the partition 2-5, and the partition 2-6 of the installation member 2 are bent in two-stages, formed in a concave shape (more particularly, a concave shape when viewed from the lower side). As a result, the light emitting device module 1-4 mounted on the partition 2-4 and the light emitting device module 1-6 mounted on the partition 2-6 are pointed in directions that are different from each other. Furthermore, angles made by the partitions 2-1 and 2-3 bent against the partition 2-2 of the installation member 2 are set to have angular values that are different from the angles made by the partitions 2-4 and 2-6 bent against the partition 2-5 of the installation member 2. As a result, the light emitting device module 1-4 mounted on the partition 2-4 and the light emitting device module 1-6 mounted on the partition 2-6 are pointed in directions that are also different from the light emitting device modules 1-1, 1-2, and 1-3.

In addition, the partition 2-7, the partition 2-8, and the partition 2-9 of the installation member 2 are bent in two-stages, and formed in a concave shape (more particularly, a concave shape when viewed from the lower side). As a result, the light emitting device module 1-7 mounted on the partition 2-7, the light emitting device module 1-8 mounted on the partition 2-8, and the light emitting device module 1-9 mounted on the partition 2-9 are pointed in directions that are different from one another. In addition, as shown in FIG. 3(B) and FIG. 4(B), the partition 2-5 and the partition 2-8 of the installation member 2 are bent in a convex shape (more particularly, a convex shape when viewed from the lower side). As a result, the light emitting device module 1-7 mounted on the partition 2-7, the light emitting device 1-8 mounted on the partition 2-8, and the light emitting device module 1-9 mounted on the partition 2-9 are pointed in directions that are different from the directions of the light-emitting modules 1-1, 1-2, 1-3, 1-4, and 1-6.

In addition, the partition 2-10, the partition 2-11, and the partition 2-12 of the installation member 2 are bent in two-stages, and formed in a concave shape (more particularly, a concave shape when viewed from the lower side). As a result, the light emitting device module 1-10 mounted on the partition 2-10 and the light emitting device module 1-12 mounted on the partition 2-12 are pointed in directions that are different from each other. Furthermore, the angles made by the partitions 2-7 and 2-9 that are bent against the partition 2-8 of the installation member 2 are set to have angular values that are different from the value of angles made by the partitions 2-10 and 2-12 bent against the partition 2-11 of the installation member 2. As a result, the light emitting device module 1-10 mounted on the partition 2-10, and the light emitting device module 1-12 mounted on the partition 2-12, are pointed in directions that are different from directions at which the light emitting device modules 1-1, 1-2, 1-3, 1-4, 1-6, 1-7, 1-8 and 1-9 point.

In addition, the partition 2-13, the partition 2-14, and the partition 2-15 of the installation member 2 are bent in two-stages, and formed in a concave shape (more particularly, a concave shape when viewed from the lower side). As a result, the light emitting device module 1-13 mounted on the partition 2-13 and the light emitting device module 1-15 mounted on the partition 2-15 are pointed in directions that are different from each other. In addition, as shown in FIG. 3(B) and FIG. 4(B), the partition 2-11 and the partition 2-14 of the installation member 2 are bent in a convex shape (more particularly, a convex shape when viewed from the lower side). As a result, the light emitting device module 1-13 mounted on the partition 2-13, and the light emitting device 1-15 mounted on the partition 2-15, are pointed in directions that area also different from the directions at which light-emitting modules 1-1, 1-2, 1-3, 1-4, 1-6, 1-7, 1-8, 1-9, 1-10, and 1-12 point.

In addition, the partition 2-16, the partition 2-17, and the partition 2-18 of the installation member 2 are bent in two-stages, and formed in a concave shape (more particularly, a concave shape when viewed from the lower side). As a result, the light emitting device module 1-16 mounted on the partition 2-16 and the light emitting device module 1-18 mounted on the partition 2-18 are pointed in directions that are different from each other. Furthermore, the angles made by the partitions 2-13 and 2-15 bent against the partition 2-14 of the installation member 2 are set to be values different from the angular value of angles made by the partitions 2-16 and 2-18 bent against the partition 2-17 of the installation member 2. As a result, the light emitting device module 1-16 mounted on the partition 2-16, and the light emitting device module 1-18 mounted on the partition 2-18, are pointed in directions that are different from directions at which the light-emitting modules 1-1, 1-2, 1-3, 1-4, 1-6, 1-7, 1-8, 1-9, 1-10, 1-12, 1-13, and 1-15 point.

Figure 5:
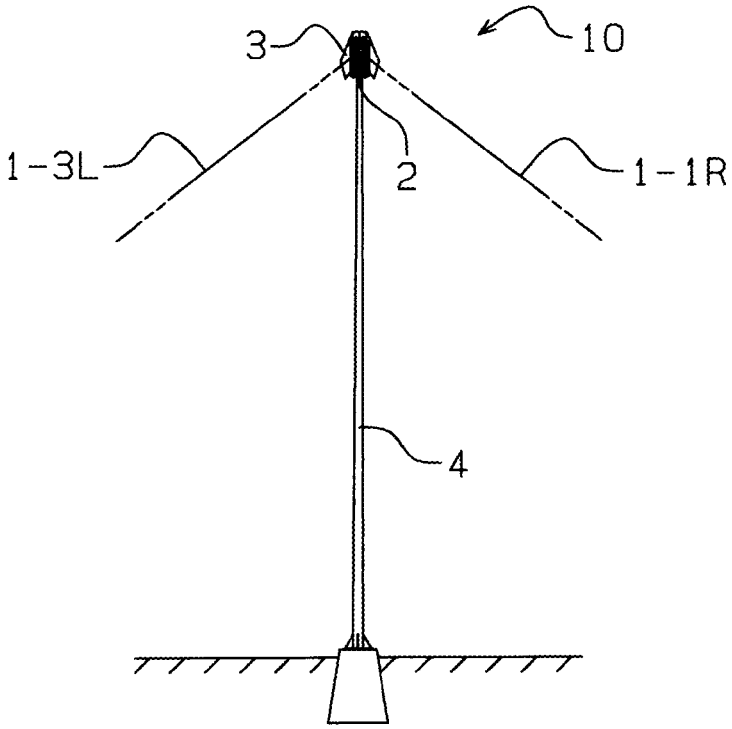
FIGS. 5(A) & (B) are a front view and a side view, respectively, illustrating an overall assembly of a lighting fixture made in accordance with principles of the disclosed subject matter.
Figure 5:
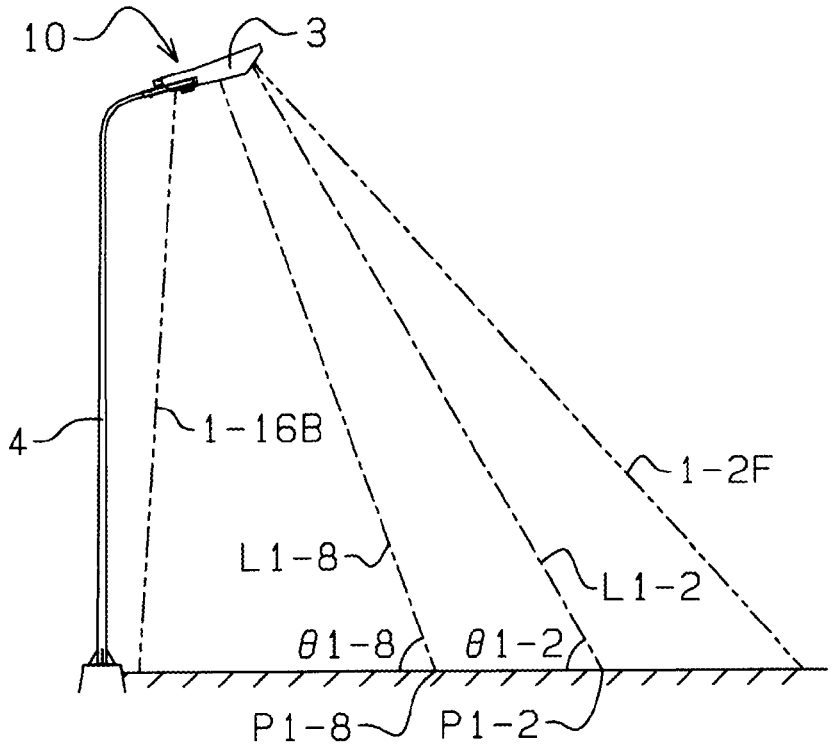

FIG. 5 is an overall view of a lighting fixture 10 according to the first embodiment. In more detail, FIG. 5(A) is a front view of the lighting fixture 10 of the first embodiment, and FIG. 5(B) is a left side view of the lighting fixture 10 of the first embodiment.

In FIG. 5, reference numeral 4 indicates a support for supporting the installation member 2 as shown in FIG. 3 and FIG. 4. The reference numeral 1-1R indicates the right end (the upper end of FIG. 2) of the light distribution pattern emitted from the light emitting device module 1-1 shown in FIG. 3 (A) and FIG. 3 (B). The reference numeral 1-3L indicates the left end (lower end of FIG. 2) of the light distribution pattern emitted from the light emitting device module 1-3 shown in FIG. 3 (A) and FIG. 3 (B).

In FIG. 5(B), the reference numeral L1-2 indicates the main optical axis line of the light emitting device module 1-2 shown in FIG. 3(A), FIG. 3(B), and FIG. 4(B). The reference numeral L1-8 indicates the main optical axis line of the light emitting device module 1-8 shown in FIG. 3(A), FIG. 3(B), and FIG. 4(B). The reference numeral θ1-2 indicates the angle between the main optical axis line L1-2 of the light emitting device module 1-2 and the horizontal plane HL (see FIG. 4(B)). The reference numeral θ1-8 indicates the angle between the main optical axis line L1-8 of the light emitting device module 1-8 and the horizontal plane HL (see FIG. 4(B)). The reference numeral 1-2F indicates the front end (the right end of FIG. 2) of the light distribution pattern emitted from the light emitting device module 1-2. The reference numeral 1-16B indicates the rear end (the left end of FIG. 2) of the light distribution pattern emitted from the light emitting device module 1-16.

In the lighting fixture 10 according to the first embodiment, as shown in FIG. 3 to FIG. 5, the installation member 2 is mounted on the support 4 via a part of the lampshade 3. Alternatively, as a third embodiment, the installation member 2 may be directly mounted on the support 4, or the installation member 2 may be mounted on the support 4 via a member other than the lampshade 3.

In the lighting fixture 10 according to the first embodiment, as shown in FIG. 3(A), FIG. 3(B), FIG. 4(B), and FIG. 5(B), the installation member 2 is bent in two stages to be formed in a convex shape (more particularly, a convex shape when viewed from a lower side), in such a manner that the angle θ1-2 between the main optical axis line L1-2 of the light emitting device module 1-2 mounted on a part of the forefront side (the front side), (e.g., the upper side of FIG. 3(A), the upper side of FIG. 3(B), the right side of FIG. 4(B), and the right side of FIG. 5(B)) of the installation member 2, and the horizontal plane HL (see FIG. 4(B)) is smaller than the angle θ1-8 between the main optical axis line L1-8 of the light emitting device module 1-8 mounted to the rear of the light emitting device module 1-2 (a root side of the installation member 2), (e.g., the lower side of FIG. 3(A), the lower side of FIG. 3(B), the left side of FIG. 4(B), and the left side of FIG. 5(B)), and the horizontal lane HL (see FIG. 4(B)).

In other words, as shown in FIG. 4(B), the installation member 2 is bent in two stages in the longitudinal direction (the lateral direction of FIG. 4(B)). As a result, the angle θ1-2 between the main optical axis line L1-2 of the light emitting device module 1-2 and the horizontal plane HL is smaller than the angle θ1-8 between the main optical axis line L1-8 of the light emitting device module 1-8 and the horizontal plane HL. The light emitting device module 1-2 is shown as being mounted on the forefront side (the right side of FIG. 4(B)) of the installation member 2, while the light emitting device module 1-8 is shown as being mounted closer to the root side of the installation member 2 than the light emitting device module 1-2.

In more detail, the main optical axis line L1-2 of the light emitting device module 1-2 mounted on the part on the forefront side (the right side of FIG. 4(B) and the right side of FIG. 5(B)) of the installation member 2 is pointed to the position P1-2 which is located at a predetermined distance from the lighting fixture 10. The main optical axis line L1-8 of the light emitting device module 1-8 is mounted on a part closer to the root side (the left side of FIG. 4(B) and the left side of FIG. 5(B)) of the installation member 2, relative to the light emitting device module 1-2, and is pointed to the position P1-8 which is closer to the lighting fixture 10 than position P1-2.

Therefore, the light beams from the light emitting device modules 1-1, 1-2, 1-3, 1-4, 1-6, 1-7, 1-8, 1-9, 1-10, 1-12, 1-13, 1-15, 1-16, 1-18 enable illumination at wide-angle in the longitudinal direction (the lateral direction in FIG. 5 (B)).

In other words, according to the lighting fixture 10 of the first embodiment, it is possible to brightly illuminate both the position close to the lighting fixture 10 and the position distant from the lighting fixture 10, in the front side of the lighting fixture 10 (the right side of FIG. 5(B)).

Therefore, when the lighting fixture 10 of the first embodiment is installed on the edge of the road, both a road surface at the position close to the lighting fixture 10 and a road surface at the position distant from the lighting fixture 10 can be brightly illuminated, in the road lane direction (lateral direction of FIG. 5(B)).

In addition, in the lighting fixture 10 of the first embodiment, as shown in FIG. 4(B) and FIG. 5(B), the main optical axis line L1-2 of the light emitting device module 1-2 mounted on the forefront side (the right side of FIG. 4(B)) of the installation member 2 is directed to the position P1-2 at a distance from the lighting fixture 10. Therefore, an optical path from the light emitting device module to the illuminated position P1-2 can be made shorter than the case where the main optical axes of the light emitting device modules (e.g., light emitting device modules 1-16, 1-18, and the like) mounted on the root side of the installation member (the left side of FIG. 4(B)) are directed to the position P1-2 from the lighting fixture 10. Consequently, it is possible to brightly illuminate the position P1-2 even though it is distant from the lighting fixture 10.

Furthermore, in the lighting fixture 10 of the first embodiment, as shown in FIG. 1(A) and FIG. 1(C), the lens 1*c* is provided for focusing the light emitted from the light emitting device 1*a*. As shown in FIG. 2, the property of light convergence of the lens 1*c* is configured in such a manner that the degree of light convergence in the lateral direction (upper-lower direction of FIG. 2) of the lighting fixture 10 becomes smaller than the degree of light convergence in the longitudinal direction (lateral direction of FIG. 2) of the lighting fixture 10. In other words, the light convergence property of the lens 1*c* is configured in such a manner that a light distribution pattern size in the lateral direction (the size in the upper-lower direction in FIG. 2) emitted from the light emitting device module 1 is larger than the size in the longitudinal direction (the size in the lateral direction in FIG. 2).

Therefore, according to the lighting fixture 10 of the first embodiment, while keeping the size in the lateral direction of the light emitting device module 1 (the size in the lateral direction of FIG. 1(B) and the size in the lateral direction of FIG. 1(D)) small, the light from the light emitting device module 1 enables illumination at wide angle in the lateral direction (the lateral direction of FIG. 5(A)). According to the lighting fixture 10 of the first embodiment, while keeping the size small in the lateral direction (the size in the lateral direction of FIG. 3(A) and the size in the lateral direction of FIG. 3(B)) of the installation member 2 on which multiple light emitting device modules 1 (1-1, 1-2, 1-3, 1-4, 1-6, 1-7, 1-8, 1-9, 1-10, 1-12, 1-13, 1-15, 1-16, and 1-18) are mounted, the light emitting device module 1 enables illumination at a wide angle in the lateral direction (the lateral direction of FIG. 5(A)) of the lighting fixture 10.

In other words, according to the lighting fixture 10 of the first embodiment, as shown in FIG. 3(A), FIG. 3(B), and FIG. 5(A), while keeping the multiple light emitting device modules 1 (1-1, 1-2, 1-3, 1-4, 1-6, 1-7, 1-8, 1-9, 1-10, 1-12, 1-13, 1-15, 1-16, and 1-18), and the installation member 2 protruding less from the support 4 in the lateral direction (the lateral direction of FIG. 5(A)), the light emitting device module 1 is capable of illuminating at a wide angle in the lateral direction (the lateral direction of FIG. 5(A)) of the lighting fixture 10.

In FIG. 3(A) and FIG. 3(B), provisionally, if the light emitting device modules 1 whose number is the same as the partition number (eighteen partitions) of the installation member 2, are mounted on the installation member 2, the light from the light emitting device module 1-2 mounted on the partition 2-2 overlaps the light from the light emitting device module 1 mounted on the partition 2-5. The light from the light emitting device module 1-8 mounted on the partition 2-8 overlaps the light from the light emitting device module 1 mounted on the partition 2-11. In addition, the light from the light emitting device modules 1-13 and 1-15 mounted on the partitions 2-13 and 2-15 overlaps the light from the light emitting device module 1 mounted on the partitions 2-14. Furthermore, the light from the light emitting device modules 1-16 and 1-18 overlaps the light from the light-emitting module 1 mounted on the partition 2-17.

On the other hand, in the lighting fixture 10 of the first embodiment, the partition 2-5 is not equipped with the light emitting device module 1, in order to avoid light from the light emitting device module 1-2 mounted on the partition 2-2 from overlapping the light from the light emitting device module 1 mounted on the partition 2-5. In addition, the partition 2-11 is not equipped with the light emitting device module 1, in order to avoid light from the light emitting device module 1-8 mounted on the partition 2-8 from overlapping the light from the light emitting device module 1 mounted on the partition 2-11. Furthermore, the partition 2-14 is not equipped with the light emitting device module 1, in order to avoid light from the light emitting device modules 1-13 and 1-15 mounted on the partitions 2-13 and 2-15 from overlapping the light from the light emitting device module 1 mounted on the partition 2-14. Similarly, the partition 2-17 is not equipped with the light emitting device module 1, in order to avoid light from the light emitting device modules 1-16 and 1-18 mounted on the partitions 2-16 and 2-18 from overlapping the light from the light emitting device module 1 mounted on the partition 2-17.

As thus discussed, the light emitting device modules 1 whose number (fourteen) is less than the number of partitions (eighteen units) of the installation member 2 are mounted on the installation member 2. Therefore, it is possible to reduce the number of light emitting device modules 1 without deteriorating global performance of the lighting fixture. As a result, according to the lighting fixture 10 of the first embodiment, it is possible to reduce manufacturing cost and operation cost of the lighting fixture 10, without experiencing a deterioration in global performance of the lighting fixture.

In other words, in the lighting fixture 10 of the first embodiment, the partitions whose number is larger than the number of the light emitting device modules 1, are formed on the installation member 2. Therefore, by changing the partition on which the light emitting device module 1 is mounted, that is, by changing the position where the light emitting device module 1 is mounted, the global property of the lighting fixture can be easily modified. For example, the global property of the lighting fixture can be easily modified depending on the how the lighting fixture 10 is installed.

In the lighting fixture 10 of the first embodiment, as shown in FIG. 3(A) and FIG. 3(B), fourteen light emitting device modules 1 are mounted on the installation member 2 which includes eighteen partitions. Alternatively, as a fourth embodiment, it is possible to mount the light emitting device modules 1 whose number is any number other than fourteen, on the installation member 2 having the partitions whose number is any number that is larger than the number of the light emitting device modules 1.

In the lighting fixture 10 of the first embodiment, the area illuminated by one light emitting device module 1 does not coincide approximately with the area illuminated by the overall lighting fixture, but the area illuminated by one light emitting device module 1 is made smaller than the area illuminated by the overall lighting fixture.

In other words, an illumination area of the overall lighting fixture is divided into multiple small areas, and the illumination area of one light emitting device module 1 is allocated to one of the small areas. There is provided an overlapping part between the illumination areas of adjacent light emitting device modules 1.

Next, with reference to FIG. 6 and FIG. 7, the lighting fixture according to a fifth embodiment of the disclosed subject matter will be explained. The lighting fixture 10 of the fifth embodiment has a configuration approximately the same as the lighting fixture 10 of the first embodiment as described above, except for the specific configuration of the light emitting device.

Figure 6:
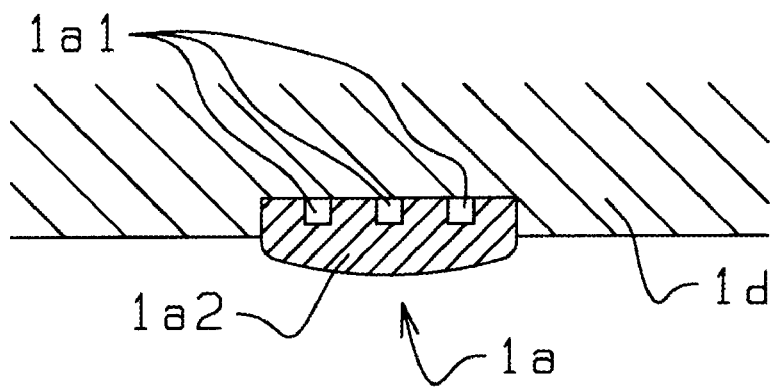
FIG. 6 is an enlarged sectional view of a light emitting device (LED package) made in accordance with principles of the disclosed subject matter.

FIG. 6 is an enlarged sectional view of the light emitting device (LED package) 1*a*, and the like, of the lighting fixture 10 according to the fifth embodiment. In the lighting fixture of the fifth embodiment, as shown in FIG. 6, the light emitting device (LED package) 1*a* can consist of or include an LED 1*a*1 or LEDs 1*a*1 and a fluorescent substance 1*a*2 arranged so as to cover the LEDs 1*a*1. The fluorescent substance 1*a*2 is selected primarily for color reproducibility and high brightness. By way of example, the selected fluorescent substance can be excited by blue light and/or ultraviolet radiation to emit colored light, which can be combined with the original LED emission light to provide another wavelength of light, such as white light.

Figure 7:
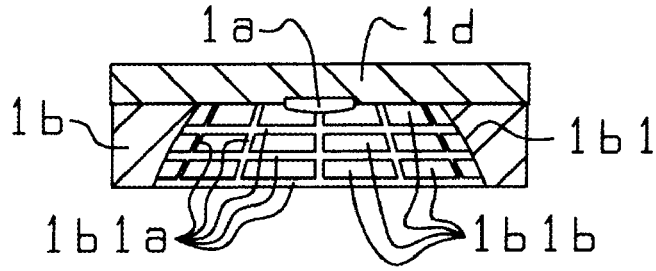
FIGS. 7(A) & (B) are an enlarged side view and an enlarged top view, respectively, of the light emitting device (LED package), reflector, and thermal interface material of the lighting fixture of FIG. 6.
Figure 7:
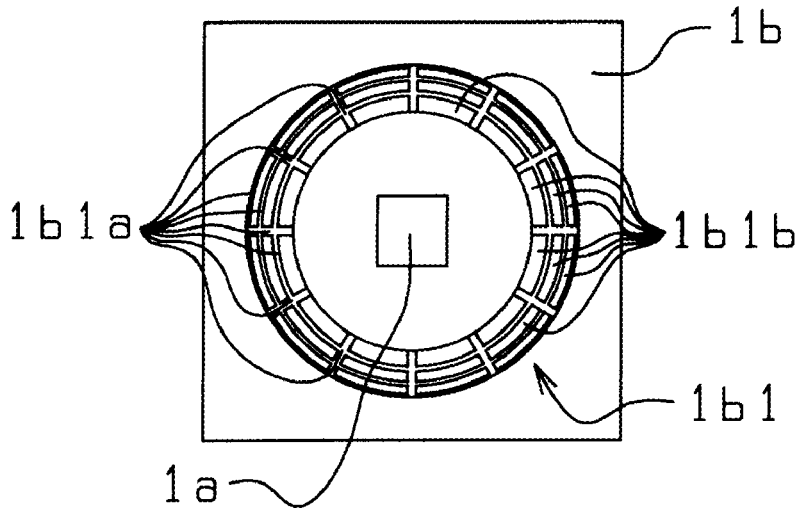

FIG. 7 illustrates enlarged views of the light emitting device (LED package) 1*a*, the reflector 1*b*, and the thermal interface material 1*d* of the lighting fixture 10 according to the fifth embodiment. FIG. 7(A) is an enlarged sectional front view of the light emitting device (LED package) 1*a*, the reflector 1*b*, and the thermal interface material 1*d*. FIG. 7 (B) is a bottom view thereof, i.e., it is an illustration when viewing the illustration of FIG. 7(A) from the lower side.

In the lighting fixture of the fifth embodiment, as shown in FIG. 7(A) and FIG. 7(B), there are provided on the reflection surface 1*b*1 of the reflector 1*b*, a part 1*b*1*a* where a light-storage material is placed and a part 1*b*1*b* where the light-storage material is not placed. In more detail, the light-storage material can be applied in the form of mesh on the reflection surface 1*b*1 of the reflector 1*b*, thereby forming the part 1*b*1*a* where the light-storage material is placed. Furthermore, the light-storage material can be applied all over the lower surface (the surface on the lower side of FIG. 7(A)) of the reflector 1*b*. As a light-storage material, a fluorescent material can be used, which has a long persistence, light brightness, and reliability, for example. Specifically, a material made up of rare earth activated divalent metal aluminate, a material made up of rare earth activated divalent metal boric acid substitution aluminate, a material made up of europium, rare earth, etc., co-activated silicate, a material made up of europium activated rare earth oxide sulfate, or the like, or combinations thereof, can be employed as the light-storage material.

A part of the heat generated by the heat-emitting element (LED package) 1*a* is thermally conducted to the light-storage material on the reflection surface 1*b*1 of the reflector 1*b* and the light-storage material on the lower surface of the reflector 1*b*, via the thermal interface material 1*d* and the reflector 1*b*. Accordingly, the temperature of the light-storage material is raised, thereby enhancing the emission intensity of the light-storage material.

In the lighting fixture of the fifth embodiment, as shown in FIG. 1, FIG. 6, and FIG. 7, when the LED 1*a*1 is ON, a part of the light emitted from the LED 1*a*1 and the fluorescent substance 1*a*2 is subjected to the light distribution control by the lens 1*c*, and illuminates the lower side of FIG. 1(A). In addition, when the LED 1*a*1 is ON, a part of the light emitted from the LED 1*a*1 and the fluorescent substance 1*a*2 is reflected by the part 1*b*1*b* on which the light-storage material is not placed on the reflection surface 1*b*1 of the reflector 1*b*. The light distribution of the reflected light can be controlled by the lens 1*c* so as to illuminate the lower side of FIG. 1 (A). Furthermore, when the LED 1*a*1 is ON, a part of the light emitted from the LED 1*a*1 and the fluorescent substance 1*a*2, and a part of the light which enters in the light emitting device module 1 from the outside of the light emitting device module 1 (e.g., sun light, light from other lighting fixture, or the like), are stored in the light-storage material on the reflection surface 1*b*1 on the reflector 1*b*, and in the light-storage material on the lower surface of the reflector 1*b*.

When the LED 1*a*1 is OFF, the light from the light-storage material on the reflection surface 1*b*1 of the reflector 1*b* is emitted, and the light distribution of the emitted light is controlled by the lens 1*c* so as to illuminate the lower side of FIG. 1(A). Further, when the LED 1*a*1 is OFF, the light from the light-storage material on the lower surface of the reflector 1*b* is emitted, thereby illuminating the lower side of FIG. 1(A).

The LED 1*a*1 can be driven by pulsed energy, considering afterglow luminance of the light-storage material, and when the LED 1*a*1 is OFF, the light emitted from the light-storage material is used subsidiarily. Therefore, power saving is promoted.

In more detail, as to the light-storage material, the afterglow luminance, an afterglow time, and a time length until reaching a saturated luminance are taken into account, and the OFF period of the LED 1*a*1 is set, so that a user of the lighting fixture is allowed to obtain a maximum luminance from the light-storage material to the extent that the user does not feel or observe blinking of the LED 1*a*1, while the LED 1*a*1 is OFF.

As described above, in the lighting fixture of the first embodiment, the fluorescent substance and the light-storage material are not provided, whereas in the lighting fixture of the fifth embodiment, the fluorescent substance 1*a*2 and the light-storage material are provided.

As discussed above, in the lighting fixture 10 of the fifth embodiment, the light-storage material is placed on the reflection surface 1*b*1 for reflecting the light from the LED 1*a*1 (see FIG. 6) and light from the fluorescent substance 1*a*2 (see FIG. 7). Therefore, the light stored in the light-storage material while the LED 1*a*1 is ON (more particularly, the light from the LED 1*a*1 and the fluorescent substance 1*a*2, and the light from outside of the lighting fixture 10 such as the sunlight and the light from other lighting fixture) can be emitted while the LED 1*a*1 is OFF. Since auxiliary light can be emitted while the LED 1*a*1 is OFF, it is possible to reduce the power consumption of the LED 1*a*1.

In addition, in the lighting fixture 10 of the fifth embodiment, the fluorescent substance 1*a*2 (see FIG. 6) is selected primarily for color reproduction and high brightness. Therefore, it is possible to achieve at least the following three purposes simultaneously; power saving, color reproduction, and higher brightness.

Furthermore, as shown in FIG. 7, the light-storage material is applied in the form of mesh on the reflection surface 1*b*1 of the reflector 1*b*, and consequently, the part 1*b*1*a* where the light-storage material is placed, and the part 1*b*1*b* where the light-storage material is not placed are provided on the reflection surface 1*b*1 of the reflector 1*b*. In other words, the light-storage material is not placed all over the reflection surface 1*b*1. The part 1*b*1*b* where light-storage material is not placed remains is included on the reflection surface 1*b*1.

Therefore, it is possible to increase the reflective index of the reflection surface 1*b*1, as compared to the case where the light-storage material is placed all over the reflection surface 1*b*1. In addition, the possibility can be reduced that the light reflected from the reflection surface 1*b*1 is weakened when the LED 1*a*1 is ON. In other words, according to the lighting fixture 10 of the fifth embodiment, when the LED 1*a*1 is OFF, auxiliary light can be emitted, while reducing the possibility that the light reflected from the reflection surface 1*b*1 is weakened when the LED 1*a*1 is ON.

Furthermore, in the lighting fixture of the fifth embodiment, as shown in FIG. 1, FIG. 6, and FIG. 7, the thermal interface material 1*d* having a heat transferring function, and the reflector 1*b* are placed between the LED 1*a*1 with the fluorescent substance 1*a*2, and the light-storage material, and the LED 1*a*1, the fluorescent substance 1*a*2, and the light-storage material are thermally connected. The thermal interface material 1*d* and the reflector 1*b* placed between the LED 1*a*1 with the fluorescent substance 1*a*2 and the light-storage material can function as a heat sink.

Therefore, it is possible to raise the temperature of the light-storage material by the heat generated from the LED 1*a*1, thereby enhancing the emission intensity of the light-storage material.

Figure 8:
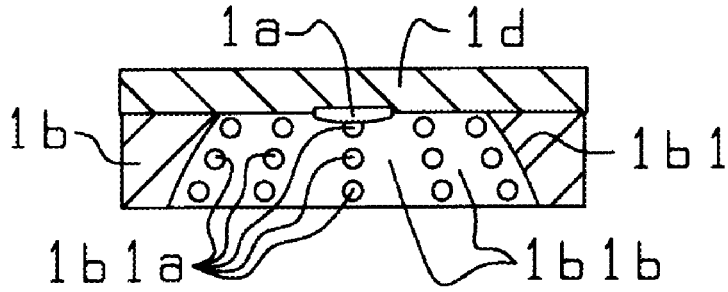
FIGS. 8(A) & (B) are an enlarged side view and an enlarged top view, respectively, of another example of a light emitting device (LED package), reflector, and thermal interface material made in accordance with principles of the disclosed subject matter.
Figure 8:
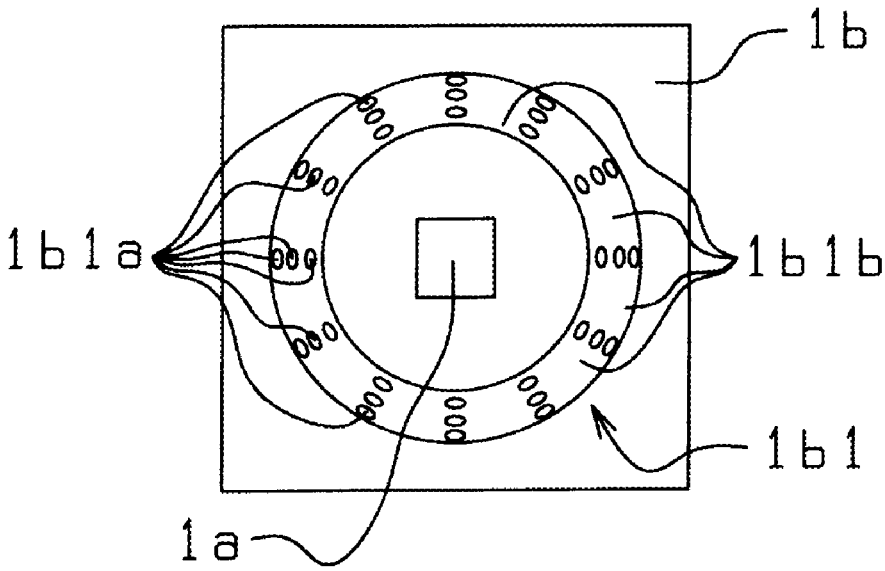

Next, the sixth to ninth embodiments will be explained. These embodiments are different from the fifth embodiment, especially with respect to the structure of the reflector of the light emitting device. FIG. 8 illustrates enlarged views of the light emitting device (LED package) 1*a*, the reflector 1*b*, and the thermal interface material 1*d*, of the lighting fixture according to the sixth embodiment. In more detail, FIG. 8 (A) is an enlarged sectional front view of the light emitting device (LED package) 1*a*, the reflector 1*b*, and the thermal interface material 1*d*, of the lighting fixture according to the sixth embodiment. FIG. 8 (B) is a bottom view of these elements, i.e., an illustration viewed from the lower side of FIG. 8(A).

As shown in FIG. 8(A) and FIG. 8(B), in the lighting fixture of the sixth embodiment, there are provided on the reflection surface 1*b*1 of the reflector 1*b* a part 1*b*1*a* where the light-storage material is placed and a part 1*b*1*b* where the light-storage material is not placed.

Specifically, in the lighting fixture of the fifth embodiment, as shown in FIG. 7(A) and FIG. 7(B), the light-storage material is applied in the form of mesh on the reflection surface 1*b*1 of the reflector 1*b*, thereby forming the part 1*b*1*a* where the light-storage material is placed. Alternatively, in the sixth embodiment, as shown in FIG. 8(A) and FIG. 8(B), the light-storage material is applied in the form of dots on the reflection surface 1*b*1 of the reflector 1*b*, thereby forming the part 1*b*1*a* on which the light-storage material is placed.

FIG. 9 illustrates enlarged views of the light emitting device (LED package) 1*a*, the reflector 1*b*, the thermal interface material 1*d*, and the like, of the lighting fixture according to the seventh embodiment. In more detail, FIG. 9(A) is an enlarged sectional front view of the light emitting device (LED package) 1*a*, the reflector 1*b*, the thermal interface material 1*d*, and the like, of the light emitting device in the lighting fixture according to the seventh embodiment. FIG. 9(B) is a bottom view of these elements, i.e., an illustration viewed from the lower side of FIG. 9(A).

In the lighting fixture 10 of the fifth embodiment, as shown in FIG. 7(A) and FIG. 7(B), the light-storage material is applied in the form of mesh on the reflection surface 1*b*1 of the reflector 1*b*, thereby forming the part 1*b*1*a* on which the light-storage material is placed. Alternatively, in the seventh embodiment, as shown in FIG. 9(A) and FIG. 9(B), a mesh-like sheet 1*g* containing the light-storage material is attached to the reflection surface 1*b*1 of the reflector 1*b*, thereby forming the part on which the light-storage material is placed.

As a result, in the lighting fixture of the seventh embodiment, similar to the lighting fixture of the fifth embodiment, there are provided on the reflection surface 1*b*1 of the reflector 1*b*, a part where the light-storage material is placed (1*g*) and a part where the light-storage material is not placed.

Figure 10:
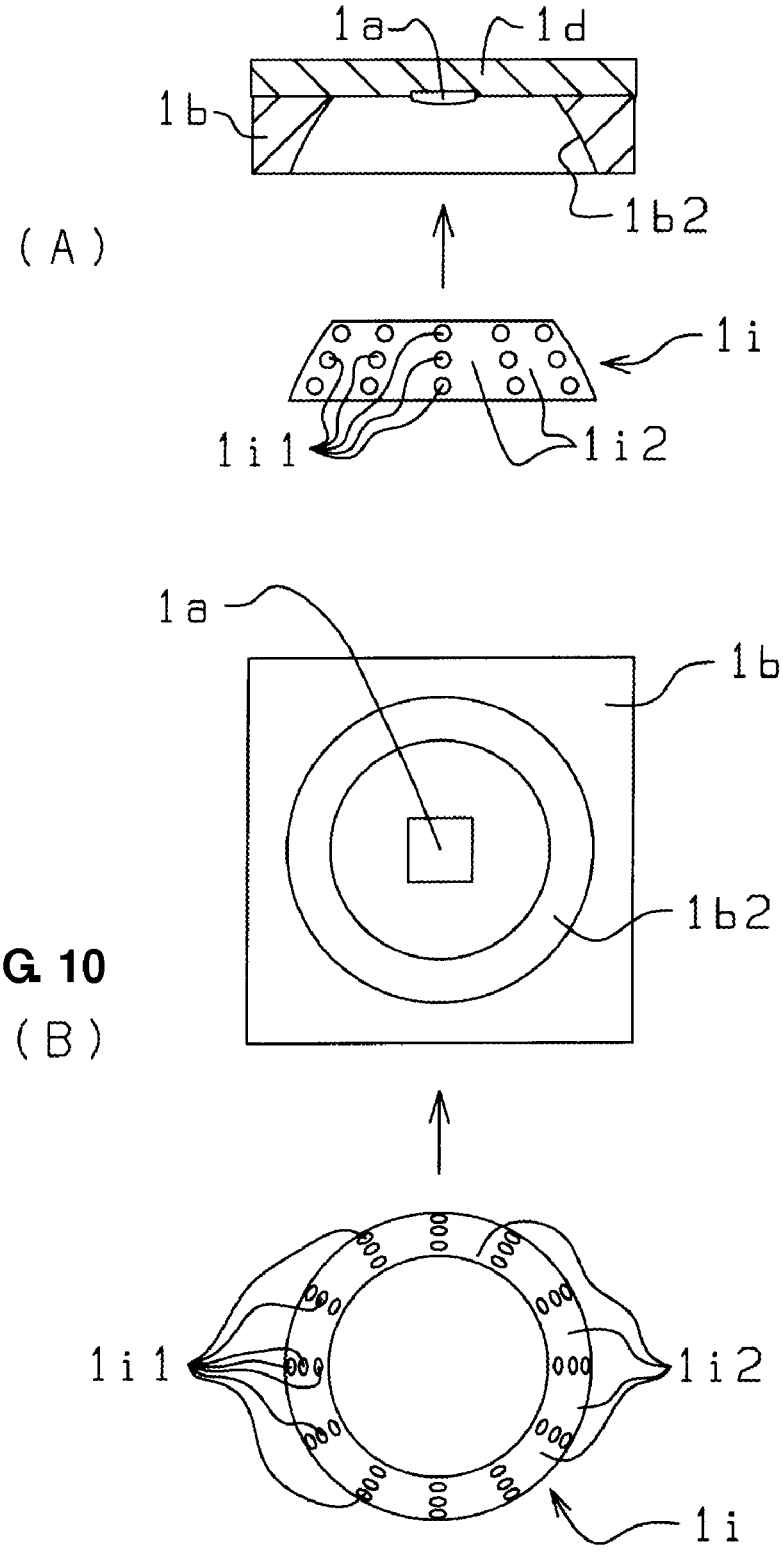
FIGS. 10(A) & (B) are an enlarged assembly side view and an enlarged assembly top view, respectively, of another example of a light emitting device (LED package), reflector, and thermal interface material made in accordance with principles of the disclosed subject matter.

FIG. 10 illustrates enlarged views of the light emitting device (LED package) 1*a*, the reflector 1*b*, the thermal interface material 1*d*, and the like, of the lighting fixture according to the eighth embodiment. In more detail, FIG. 10(A) is an enlarged sectional front view of the light emitting device (LED package) 1*a*, the reflector 1*b*, the thermal interface material 1*d*, and the like, of the light emitting device in the lighting fixture according to the eighth embodiment. FIG. 10(B) is a bottom view of these elements, i.e., an illustration viewed from the lower side of FIG. 10(A).

In the lighting fixture 10 of the fifth embodiment, as shown in FIG. 7(A) and FIG. 7(B), the light-storage material is applied in the form of mesh, on the reflection surface 1*b*1 of the reflector 1*b*, thereby forming the part 1*b*1*a* where the light-storage material is placed. Alternatively in the lighting fixture of the eighth embodiment, as shown in FIG. 10(A) and FIG. 10(B), a sheet 1*i* having holes 1*i*1 covers the inner peripheral surface 1*b*2 of the reflector 1*b*, on which the light-storage material is applied, whereby a part where the light-storage material is placed is formed.

Specifically, in the lighting fixture of the eighth embodiment, the light-storage material, can be placed on the inner peripheral surface 1*b*2 of the reflector 1*b* and exposed via the holes 1*i*1 of the sheet 1*i*, and can store the light from the LED 1*a*1 (see FIG. 6) and the fluorescent substance 1*a*2. In addition, the part 1*i*2 of the inner peripheral surface of the sheet 1*i*, where the holes 1*i*1 are not opened, can be formed like a mirror and function to reflect the light from the LED 1*a*1 and the fluorescent substance 1*a*2 when the LED 1*a*1 is ON.

As a result, in the lighting fixture of the eighth embodiment, similar to the lighting fixture 10 of the fifth embodiment, there are provided on the reflection surface of the reflector 1*b*, the part (1*b*2, 1*i*1) where the light-storage material is placed and the part (1*i*2) where the light-storage material is not placed.

Figure 11:
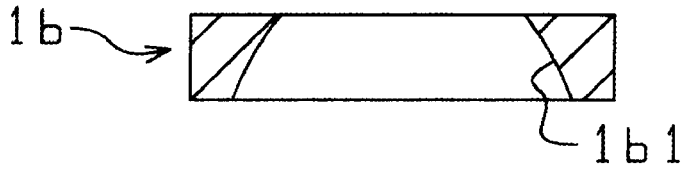
FIGS. 11(A) & (B) are an enlarged side view and an enlarged top view, respectively, of a reflector of a lighting fixture made in accordance with principles of the disclosed subject matter.
Figure 11:
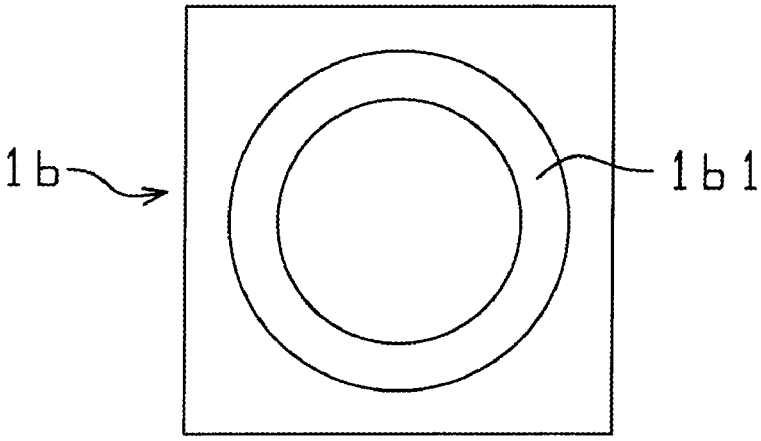

FIG. 11 illustrates enlarged views of the reflector 1*b* of the lighting fixture according to the ninth embodiment. In particular, FIG. 11(A) is an enlarged sectional from view of the reflector 1*b* of the light emitting device in the lighting fixture according to the ninth embodiment. FIG. 11(B) is a bottom view of this element, i.e., an illustration viewed from the lower side of FIG. 11(A).

In the lighting fixture 10 of the fifth embodiment, as shown in FIG. 7(A) and FIG. 7(B), the light-storage material is applied in the form of mesh, on the reflection surface 1*b*1 of the reflector 1*b*, thereby forming the part 1*b*1*a* where the light-storage material is placed. Alternatively, in the lighting fixture of the ninth embodiment, as shown in FIG. 11(A) and FIG. 11(B), the reflector 1*b* is made of a material to which the light-storage material is added (a material containing the light-storage material at the rate higher than 0% and lower than 100%), whereby a part on which the light-storage material is placed is formed on the reflection surface 1*b*1 of the reflector 1*b*. Specifically, in the lighting fixture according to the ninth embodiment, the reflector 1*b* is made of a white resin material having a high reflectance and containing light-storage material.

As a result, in the lighting fixture of the ninth embodiment, similar to the lighting fixture 10 of the fifth embodiment, there are provided on the reflection surface 1*b*1 of the reflector 1*b*, a part where the light-storage material is placed and a part where the light-storage material is not placed. For example, the reflector 1*b* may not constitute the entire reflector surface for the LED).

According to the lighting fixture of the ninth embodiment, it is possible to produce an effect similar to the effects of the fifth to eighth embodiments, without the need for applying or attaching the light-storage material.

Figure 12:
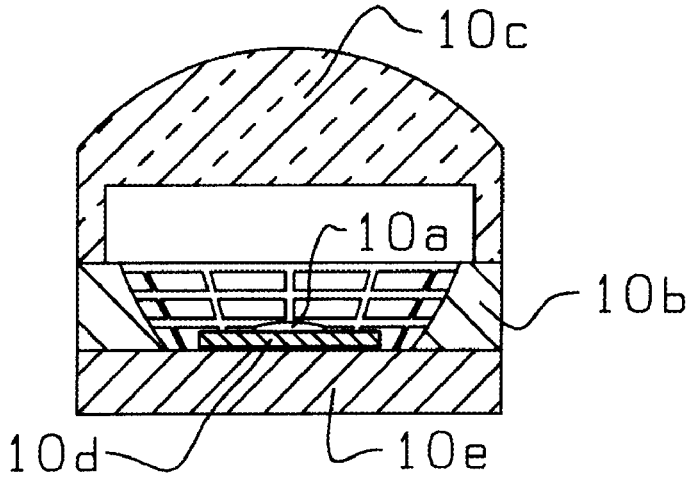
FIG. 12 is a sectional view of a light emitting device module for a lighting fixture made in accordance with principles of the disclosed subject matter.

Next, the lighting fixture of the tenth embodiment will be explained with reference to FIG. 12 and FIG. 13. The lighting fixture of the tenth embodiment is the same as the lighting fixtures of the first to the fifth embodiments, except with respect to the structure of the light emitting device. FIG. 12 is a sectional view of the light emitting device module of the lighting fixture according to the tenth embodiment. In FIG. 12, the reference numeral 10*a* indicates the light emitting device (LED package) that can be configured in a similar manner as the light emitting device (LED package) 1*a* shown in FIG. 6. The reference numeral 10*b* indicates a reflector provided with a reflection surface for reflecting the light emitted from the light emitting device (LED package) 10*a* upwardly (toward the upper side of FIG. 12). The reference number 10*c* indicates a lens that is mounted on the reflector 10*b* for controlling the light distribution of the direct light from the light emitting device (LED package) 10*a* and the light reflected from the reflection surface of the reflector 10*b*.

In FIG. 12, the reference numeral 10*d* indicates a thermal interface material for radiating or thermally conducting the heat generated by the light emitting device (LED package) 10*a*. The reference numeral 10*e* indicates a housing for supporting the reflector 10*b* and the thermal interface material 10*d*.

In the lighting fixture of the tenth embodiment, as shown in FIG. 12, a part of the heat generated by the light emitting device (LED package) 10*a* is radiated from the thermal interface material 10*d*. In addition, a part of the heat generated by the light emitting device (LED package) 10*a* is thermally conducted to the housing 10*e* via the thermal interface material 10*d*, and radiated from the surface of the housing 10*e*.

Figure 13:
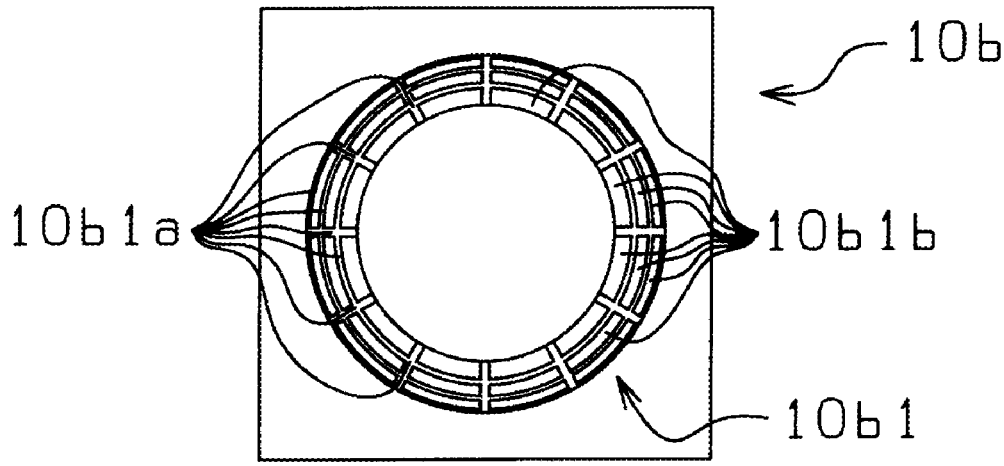
FIGS. 13(A) & (B) are a partial top view and a partial side view, respectively, of the reflector of FIG. 12.
Figure 13:
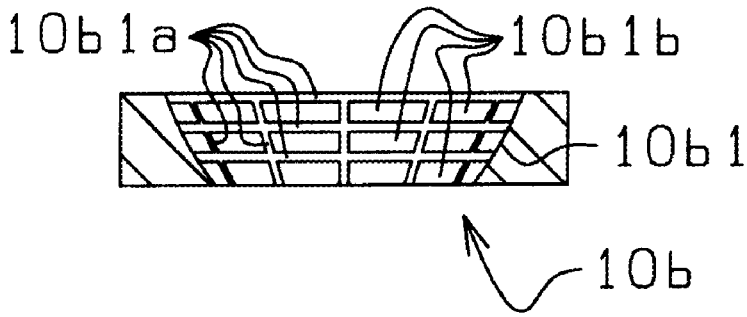

FIG. 13 is a part drawing of the reflector 10*b* that is shown in FIG. 12. Specifically, FIG. 13(A) is a plan view of the reflector 10*b*, and FIG. 13(B) is a sectional view of the reflector 10*b*.

In the lighting fixture of the tenth embodiment, as shown in FIG. 13(A) and FIG. 13(B), there are provided on the reflection surface 10*b*1 of the reflector 10*b*, a part 10*b*1*a* where the light-storage material is placed, and a part 10*b*1*b* where the light-storage material is not placed. In more detail, the light-storage material is applied in the form of mesh on the reflection surface 10*b*1 of the reflector 10*b*, thereby forming the part 10*b*1*a* where the light-storage material is placed. Furthermore, the light-storage material is applied all over the upper surface (the upper side surface of FIG. 13(B)) of the reflector 10*b*. As the light-storage material, a material similar to the one used in the fifth embodiment can be employed.

Furthermore, in the lighting fixture of the tenth embodiment as shown in FIG. 12, a part of the heat generated by the light emitting device (LED package) 10*a* is thermally conducted to the light-storage material on the reflection surface 10*b*1 of the reflector 10*b* and to the light-storage material on the upper surface of the reflector 10*b*, via the thermal interface material 10*d*, the housing 10*e*, and the reflector 10*b*. Accordingly, the temperature of the light-storage material is raised, and the emission intensity of the light-storage material is enhanced.

In addition, in the lighting fixture of the tenth embodiment, as shown in FIG. 12, when the LED is ON, a part of the light emitted from the LED and the fluorescent substance is subjected to light distribution control by the lens 10*c*, and illuminates the upper side of FIG. 12. When the LED is ON, a part of the light emitted from the LED and the fluorescent substance is reflected by the part 10*b*1*b* on which the light-storage material is not placed in the reflection surface 10*b*1 of the reflector 10*b*, and subjected to light distribution control by the lens 10*c* to illuminate the upper side of FIG. 12. Furthermore, when the LED is ON, a part of the light emitted from the LED and the fluorescent substance, and a part of the light entering the lighting fixture from the outside are stored in the light-storage material on the reflection surface 10*b*1 of the reflector 10*b* and the light-storage material on the upper surface of the reflector 10*b*.

When the LED is OFF, the light from the light-storage material on the reflection surface 10*b*1 of the reflector 10*b* is emitted, and the light distribution of the light is controlled by the lens 10*c* to illuminate the upper side of FIG. 12. Furthermore, when the LED is OFF, the light from the light-storage material on the upper surface of the reflector 10*b* is emitted, thereby illuminating the upper side of FIG. 12.

Also in the lighting fixture of the tenth embodiment, the LED is driven in a pulsed fashion, considering the afterglow luminance of the light-storage material. Thus, when the LED is OFF, the light emission from the light-storage material is subsidiarily used. Accordingly, power saving can be promoted.

With respect to the light-storage material, the afterglow luminance, the afterglow time, and the time length until reaching the saturated luminance are taken into account, and the OFF period of the LED is set, so that a user of the lighting fixture is allowed to obtain a maximum luminance from the light-storage material to the extent that the user does not feel or significantly observe blinking of the LED, while the LED is OFF.

In the lighting fixture of the tenth embodiment, as shown in FIG. 12 and FIG. 13, the light-storage material is applied in the form of mesh on the reflection surface 10*b*1 of the reflector 10*b*, thereby forming the part 10*b*1*a* where the light-storage material is placed. Alternatively, in an eleventh embodiment, the light-storage material can be applied on the reflection surface of the reflector in the form of dots, a mesh-like sheet containing the light-storage material attached to the reflector, a sheet with holes covering the reflection surface on which the light-storage material is applied, and/or the reflector can be made of a material to which the light-storage material is added, whereby the part on which the light-storage material is placed can be formed on the reflector.

Figure 14:
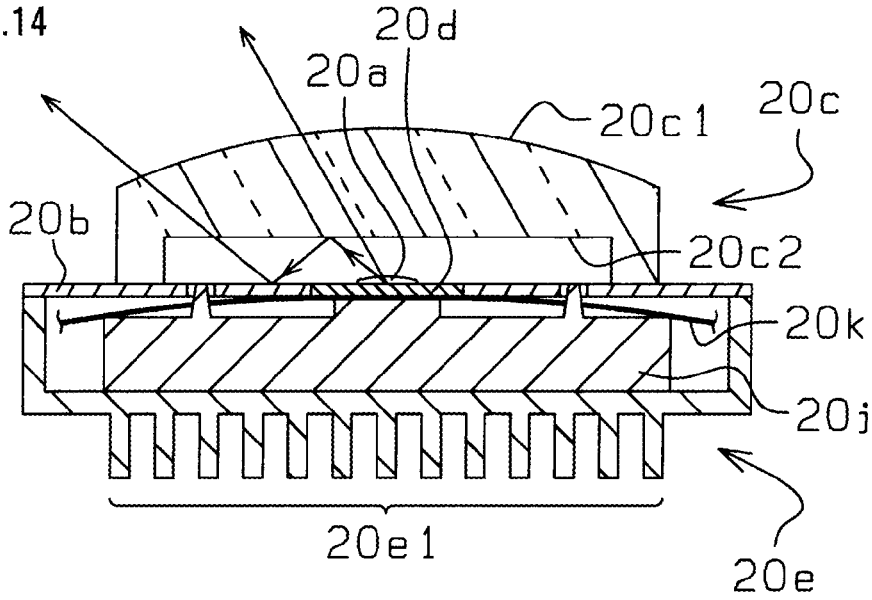
FIG. 14 is a sectional view of another light emitting device module for a lighting fixture made in accordance with principles of the disclosed subject matter.

Next, with reference to FIG. 14 and FIG. 15, the lighting fixture of the twelfth embodiment will be explained. The lighting fixture according to the twelfth embodiment is the same as the lighting fixtures of the first, the fifth, and the tenth embodiments, except with respect to the structure of the light emitting device. FIG. 14 is a sectional view of the light emitting device module of the lighting fixture according to the twelfth embodiment. In FIG. 14, the reference numeral 20*a* indicates a light emitting device which is configured in the similar manner as the light emitting device (LED package) 1*a* as shown in FIG. 6. The reference numeral 20*b* indicates a reflector provided with a reflection surface for reflecting the light from the light emitting device (LED package) 20*a* upwardly (upper side of FIG. 14). The reference numeral 20*c* indicates a lens mounted on the reflector 20*b* for controlling the light distribution control of the direct light from the light emitting device (LED package) 20*a*, and the light reflected from the reflection surface of the reflector 20*b*. The reference numeral 20*c*1 indicates the upper surface of the lens 20*c*, and 20*c*2 indicates the lower surface thereof.

In FIG. 14, the reference numeral 20*d* indicates a first thermal interface material for radiating or thermally conducting the heat generated by the light emitting device (LED package) 20*a*. The reference numeral 20*j* indicates a second thermal interface material for radiating or thermally conducting the heat generated by the light emitting device (LED package) 20*a*. The reference numeral 20*e* indicates a housing for supporting the reflector 20*b* and the second thermal interface material 20*j*. The reference numeral 20*e*1 indicates fins constituting a part of the housing 20*e*. The reference numeral 20*k* indicates a flexible substrate for supplying power to the LED of the light emitting device (LED package) 20*a*.

In the lighting fixture of the twelfth embodiment, as shown in FIG. 14, a part of the heat generated by the light emitting device (LED package) 20*a* is radiated from the first thermal interface material 20*d*. A part of the heat generated by the light emitting device (LED package) 20*a* is thermally conducted to the second thermal interface material 20*j* via the first thermal interface material 20*d*, and radiated from the second thermal interface material 20*j*. Further, a part of the heat generated by the light emitting device (LED package) 20*a* is thermally conducted to the fins 20*e*1 of the housing 20*e* via the first thermal interface material 20*d* and the second thermal interface material 20*j*, and radiated from the fins 20*e*1.

Figure 15:
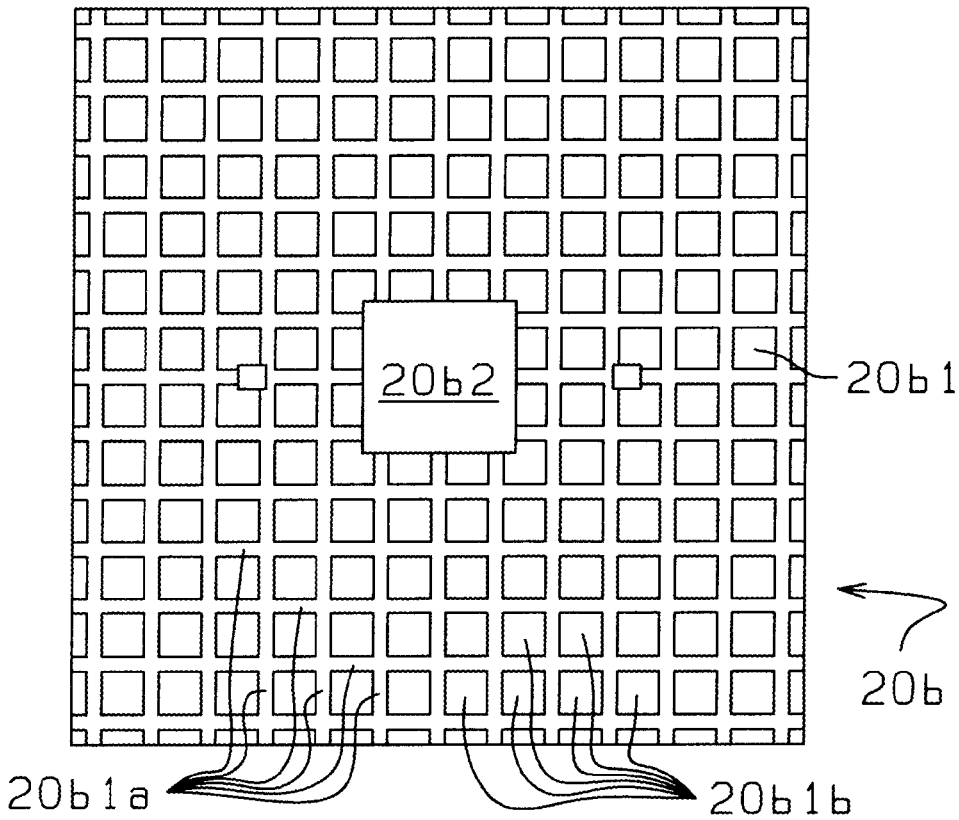
FIG. 15 is a partial drawing of the reflector shown in FIG. 14.

FIG. 15 is a part drawing of the reflector 20*b* shown in FIG. 14. In particular, FIG. 15 is a plan view of the reflector 20*b*. In FIG. 15, the reference numeral 20*b*2 indicates a hole for accommodating the first thermal interface material 20*d*.

In the lighting fixture according to the twelfth embodiment, as shown in FIG. 15, the reflection surface 20*b*1 of the reflector 20 is provided with a part 20*b*1*a* where the light-storage material is placed and a part 20*b*1*b* where the light-storage material is not placed. In particular, by applying the light-storage material on the reflection surface 20*b*1 in the form of mesh, the part 20*b*1*a* where the light-storage material is placed is formed. As the light-storage material, the material similar to the one used in the fifth embodiment can be employed.

Furthermore, in the lighting fixture of the twelfth embodiment, as shown in FIG. 14, a part of the heat generated by the light emitting device (LED package) 20*a* is thermally conducted to the light-storage material on the reflection surface 20*b*1 of the reflector 20*b*, via the first thermal interface material 20*d* and the reflector 20*b*. Accordingly, the temperature of the light-storage material is raised, and the light-emitting intensity of the light-storage material is enhanced.

In addition, in the lighting fixture according to the twelfth embodiment, as shown in FIG. 14 and FIG. 15, when the LED is ON, the light distribution of a part of the light emitted from the LED and the fluorescent substance is controlled by the lens 20*c* to illuminate the upper side of FIG. 14. In addition, when the LED is ON, a part of the light emitted from the LED and the fluorescent substance is reflected by the lower surface 20*c*2 of the lens 20*c*, and subsequently, it is reflected by the part 20*b*1*b* where the light-storage material is not placed on the reflection surface 20*b*1 of the reflector 20*b*. Then, the light distribution of the reflected light is controlled by the lens 20*c* so as to illuminate the upper side of FIG. 14. Furthermore, when the LED is ON, a part of the light emitted from the LED and the fluorescent substance, and a part of the light entering the lighting fixture from the outside are stored by the light-storage material on the reflection surface 20*b*1 of the reflector 20*b*.

When the LED is OFF, the light from the light-storage material on the reflection surface 20*b*1 of the reflector 20*b* is emitted, and the light distribution of the light is control by the lens 20*c* so as to illuminate the upper side of FIG. 14.

Also in the lighting fixture of the twelfth embodiment, the LED is driven in a pulsed fashion. Thus, considering the afterglow luminance of the light-storage material, when the LED is OFF, the light emission from the light-storage material can be subsidiarily used. Accordingly, power saving can be promoted. In particular, with respect to the light-storage material, the afterglow luminance, the afterglow time, and the time length until reaching the saturated luminance can be taken into account, and the OFF period of the LED 1*a*1 can be set so that a user of the lighting fixture is allowed to obtain a maximum luminance from the light-storage material to the extent that the user does not feel or observe blinking of the LED, while the LED is OFF.

It is to be noted here that in the lighting fixture of the twelfth embodiment, as shown in FIG. 15, the light-storage material is applied in the form of mesh on the reflection surface 20*b*1 of the reflector 20*b*, thereby forming the part 20*b*1*a* where the light-storage material is placed. Alternatively, as a thirteenth embodiment, the light-storage material can be applied on the reflection surface of the reflector in the form of dots, or a mesh-like sheet containing the light-storage material attached to the reflector, or a sheet with holes covering the reflection surface on which the light-storage material is applied, or the reflector can be made of a material to which the light-storage material is added, whereby the part on which the light-storage material is placed can be formed on the reflector.

The aforementioned embodiments from the first to the thirteenth may be combined as appropriate.

By way of example, the lighting fixture according to the disclosed subject matter may be applicable to road lighting, street lighting, indoor lighting, and the like. In particular, the lighting fixture can be configured to be mounted in a ceiling, can be configured to be connected to a wall or other structure, can be mounted on a vehicle, or hung via wires, etc.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A lighting fixture comprising, a plurality of light emitting device modules having a light emitting device, each of the light emitting device modules configured to emit light along respective optical axes, an installation member located adjacent the light emitting device modules, the installation member being bent in multiple stages and the light emitting device modules connected to the installation member such that optical axes of the plurality of light emitting device modules are pointed in separate and different directions, respectively, wherein, a forefront light emitting device module of the plurality of light emitting device modules is mounted on a forefront side of the installation member, and a root side light emitting device module of the plurality of light emitting device modules is mounted on a root side of the installation member, and wherein the multiple stages of the installation member are configured in such a manner that an angle between a main optical axis line of the forefront light emitting device module and a horizontal plane is smaller than an angle between a main optical axis line of the root side light emitting device module and the horizontal plane and wherein, the main optical axis line of the forefront light emitting device module is directed to a position distant from the lighting fixture in a front side thereof, and the main optical axis line of the root side light emitting device module is directed to a position closer to the lighting fixture in the front side thereof as compared to the position at which the forefront light emitting device module is directed.

2. The lighting fixture according to claim 1, further comprising:

a lens configured to focus the light emitted from the light emitting devices, and the lens having a converging property set so that a converging degree in a lateral direction of the lighting fixture is smaller than a converging degree in a longitudinal direction of the lighting fixture.

3. The lighting fixture according to claim 2, wherein, the installation member is divided into a set number of partitions by portions that are bent in multiple stages, and an amount of the light emitting device modules is less than the set number of partitions of the installation member, and the light emitting device modules are mounted on the installation member.

4. A lighting fixture comprising, a plurality of light emitting device modules having a light emitting device, each of the light emitting device modules configured to emit light along respective optical axes, an installation member located adjacent the light emitting device modules, the installation member being bent in multiple stages and the light emitting device modules connected to the installation member such that optical axes of the plurality of light emitting device modules are pointed in separate and different directions, respectively, wherein, a forefront light emitting device module of the plurality of light emitting device modules is mounted on a forefront side of the installation member, and a root side light emitting device module of the plurality of light emitting device modules is mounted on a root side of the installation member, and wherein the multiple stages of the installation member are configured in such a manner that an angle between a main optical axis line of the forefront light emitting device module and a horizontal plane is smaller than an angle between a main optical axis line of the root side light emitting device module and the horizontal plane and wherein, the light emitting device includes a light emitting diode (LED), a fluorescent substance is located adjacent the LED, and a reflector is located adjacent the LED and includes a reflection surface configured to reflect light from the LED and light from the fluorescent substance, and the reflection surface includes a part where a light-storage material is placed and a part where the light-storage material is not placed.

5. The lighting fixture according to claim 4, wherein the light-storage material is applied to the reflection surface in the form of at least one of mesh and dots.

6. The lighting fixture according to claim 4, wherein the part where a light-storage material is placed is configured as a mesh-like sheet containing the light-storage material and is attached to the reflection surface.

7. The lighting fixture according to claim 4, wherein a sheet having holes covers the reflector, and the light-storage material is applied to the reflector.

8. The lighting fixture according to claim 4, wherein the reflector is made of a material containing the light-storage material.

9. The lighting fixture according to claim 4, wherein a heat transfer member is located between the LED and fluorescent substance, and the light-storage material.

10. The lighting fixture according to claim 9, wherein a heat sink is located between the LED and fluorescent substance, and the light-storage material.

11. A lighting fixture comprising, a plurality of light emitting device modules having a light emitting device, each of the light emitting device modules configured to emit light along respective optical axes, an installation member located adjacent the light emitting device modules, the installation member being bent in multiple stages and the light emitting device modules connected to the installation member such that optical axes of the plurality of light emitting device modules are pointed in separate and different directions, respectively, wherein, a forefront light emitting device module of the plurality of light emitting device modules is mounted on a forefront side of the installation member, and a root side light emitting device module of the plurality of light emitting device modules is mounted on a root side of the installation member, and wherein the multiple stages of the installation member are configured in such a manner that an angle between a main optical axis line of the forefront light emitting device module and a horizontal plane is smaller than an angle between a main optical axis line of the root side light emitting device module and the horizontal plane, and a support member configured to support the installation member.

12. The lighting fixture according to claim 11, wherein the support member extends from a first side of a longitudinal axis of the installation member in a direction substantially perpendicular to the horizontal plane, and the root side light emitting device is located closer to the support member than is the forefront light emitting device.

13. The lighting fixture according to claim 4, wherein the part where the light-storage material is placed and the part where the light-storage material is not placed both face towards the LED.

14. The lighting fixture according to claim 1, wherein, the light emitting device includes a light emitting diode (LED), a reflector is located adjacent the LED and includes a reflection surface configured to reflect light emitted from the LED, and the reflection surface includes a surface facing the LED, the surface facing the LED has portions including light-storage material and portions where the light-storage material is not located.

15. The lighting fixture according to claim 1, wherein the installation member is a one piece unitary structure that includes a plurality of bends.

16. A lighting fixture comprising:

an installation structure including a plurality of mount areas;

a plurality of light emitting devices each having a separate light emitting optical axis, the plurality of light emitting devices connected to the plurality of mount areas such that at least one of the light emitting devices has an optical axis that is not parallel with another optical axis of another one of the light emitting devices, at least a portion of the light emitting devices including a reflector including a light storage material configured to emit light for a predetermined time period after exposure to light.

17. The lighting fixture according to claim 16, wherein a surface of the reflector facing a respective one of the light emitting devices includes portions that do not include the light storage material and portions that include the light storage material.

18. The lighting fixture according to claim 16, further comprising a support member connected to the installation structure and extending downward in a first direction substantially perpendicular to a horizontal plane, and a root light emitting device of the light emitting devices has an optical axis that intersects the horizontal plane at a first acute angle, and a forefront light emitting device of the light emitting devices has an optical axis that intersects the horizontal plane at a second acute angle that is less than the first acute angle, wherein the root light emitting device is located closer to the support member than the forefront light emitting device.

19. The lighting fixture according to claim 16, wherein the installation structure includes a unitary structure that includes a plurality of bent portions, the bent portions defining the mount areas.

* * * * *